US007652636B2

(12) United States Patent
Forster et al.

(10) Patent No.: US 7,652,636 B2
(45) Date of Patent: Jan. 26, 2010

(54) RFID DEVICES HAVING SELF-COMPENSATING ANTENNAS AND CONDUCTIVE SHIELDS

(75) Inventors: Ian J. Forster, Chelmsford (GB); Adrian N. Farr, Dunmow (GB); Norman A. Howard, Ilford (GB); Andrew W. Holman, West Hills, CA (US)

(73) Assignee: Avery Dennison Corporation, Pasadena, CA (US)

( * ) Notice: Subject to any disclaimer, the term of this patent is extended or adjusted under 35 U.S.C. 154(b) by 303 days.

(21) Appl. No.: 11/247,788

(22) Filed: Oct. 11, 2005

(65) Prior Publication Data

US 2006/0054710 A1 Mar. 16, 2006

Related U.S. Application Data

(63) Continuation of application No. PCT/US04/11147, filed on Apr. 12, 2004, which is a continuation-in-part of application No. 10/410,252, filed on Apr. 10, 2003, now Pat. No. 6,914,562, and a continuation-in-part of application No. 10/700,596, filed on Nov. 3, 2003, now Pat. No. 7,055,754.

(60) Provisional application No. 60/537,483, filed on Jan. 20, 2004, provisional application No. 60/517,148, filed on Nov. 4, 2003.

(51) Int. Cl.
*H01Q 1/38* (2006.01)
*G08B 13/14* (2006.01)

(52) U.S. Cl. ..... 343/860; 340/572.7; 235/492

(58) Field of Classification Search ..... 343/700 MS, 343/795, 895, 745, 749, 850, 860, 861; 235/492, 235/491; 340/572.7
See application file for complete search history.

(56) References Cited

U.S. PATENT DOCUMENTS

| | | | |
|---|---|---|---|
| 4,706,050 | A | 11/1987 | Andrews |
| 4,786,907 | A | 11/1988 | Koelle |
| 4,816,839 | A | 3/1989 | Landt |
| 5,153,983 | A | 10/1992 | Oyama |
| 5,430,441 | A | 7/1995 | Bickley et al. |
| 5,491,483 | A | 2/1996 | D'Hont |
| 5,545,291 | A | 8/1996 | Smith et al. |
| 5,557,279 | A | 9/1996 | D'Hont |
| 5,563,616 | A | 10/1996 | Dempsey et al. |
| 5,564,888 | A | 10/1996 | Doan |
| 5,621,199 | A | 4/1997 | Calari et al. |
| 5,783,856 | A | 7/1998 | Smith et al. |
| 5,793,305 | A | 8/1998 | Turner et al. |

(Continued)

FOREIGN PATENT DOCUMENTS

| | | |
|---|---|---|
| DE | 197 03 864 | 6/1998 |

(Continued)

*Primary Examiner*—Michael C Wimer

(57) ABSTRACT

A radio frequency identification (RFID) tag includes an antenna configuration coupled to an RFID chip, such as in an RFID strap. The antenna configuration is mounted on one face (major surface) of a dielectric material, and includes compensation elements to compensate at least to some extent for various types of dielectric material upon which the antenna configuration may be mounted. In addition, a conductive structure, such as a ground plane or other layer of conductive material, may be placed on a second major surface of the dielectric layer, on an opposite side of the dielectric layer from the antenna structure.

35 Claims, 10 Drawing Sheets

U.S. PATENT DOCUMENTS 5,824,186 A 10/1998 Smith et al.
5,854,480 A 12/1998 Noto
5,874,724 A 2/1999 Cato
5,904,545 A 5/1999 Smith et al.
5,965,494 A 10/1999 Terashima et al.
5,973,598 A 10/1999 Beigel
5,977,877 A 11/1999 McCulloch et al.
5,983,363 A 11/1999 Tuttle et al.
6,001,211 A 12/1999 Hiroyuki
6,043,746 A 3/2000 Sorrells
6,078,791 A 6/2000 Tuttle et al.
6,104,291 A 8/2000 Beauvillier et al.
6,107,920 A 8/2000 Eberhardt et al.
6,118,379 A * 9/2000 Kodukula et al. ..... 340/572.8
6,133,836 A 10/2000 Smith
6,140,967 A 10/2000 Kolsrud
6,145,901 A 11/2000 Rich
6,147,604 A 11/2000 Wiklof et al.
6,147,605 A 11/2000 Vega et al.
6,147,606 A 11/2000 Duan
6,166,613 A 12/2000 Nakagawa et al.
6,172,609 B1 1/2001 Lu et al.
6,204,764 B1 3/2001 Maloney
6,206,292 B1 3/2001 Robertz et al.
6,215,402 B1 4/2001 Rao Kodukula et al.
6,236,314 B1 5/2001 Smith et al.
6,236,316 B1 5/2001 Eberhardt et al.
6,243,013 B1 6/2001 Duan et al.
6,259,369 B1 7/2001 Monico
6,259,408 B1 7/2001 Brady et al.
6,262,682 B1 7/2001 Shibata
6,262,692 B1 7/2001 Babb
6,265,977 B1 7/2001 Vega et al.
6,274,508 B1 8/2001 Jacobsen et al.
6,278,369 B2 8/2001 Smith et al.
6,278,413 B1 8/2001 Hugh et al.
6,281,038 B1 8/2001 Jacobsen et al.
6,281,794 B1 8/2001 Duan et al.
6,281,850 B1 8/2001 Klostermann
6,285,342 B1 * 9/2001 Brady et al. ..... 343/895
6,291,896 B1 9/2001 Smith
6,316,278 B1 11/2001 Jacobsen et al.
6,320,509 B1 11/2001 Brady et al.
6,320,545 B1 11/2001 Nagumo et al.
6,329,915 B1 12/2001 Brady et al.
6,339,385 B1 1/2002 Tuttle
6,342,866 B1 1/2002 Ho et al.
6,380,729 B1 4/2002 Smith
6,384,727 B1 5/2002 Diprizio et al.
6,392,544 B1 5/2002 Collins et al.
6,407,665 B2 6/2002 Maloney
6,417,025 B1 7/2002 Gengel
6,451,154 B1 9/2002 Grabau et al.
6,486,783 B1 11/2002 Hausladen et al.
6,501,435 B1 12/2002 King et al.
6,504,511 B2 1/2003 Andersson
6,535,175 B2 3/2003 Brady et al.
6,563,463 B1 5/2003 Saito
6,577,208 B2 6/2003 Kushitani et al.
6,600,420 B2 7/2003 Goff et al.
6,665,193 B1 12/2003 Chung et al.
6,667,092 B1 12/2003 Brollier et al.
6,683,254 B1 1/2004 Gunnels
6,690,264 B2 2/2004 Dalglish
6,703,985 B2 3/2004 Lee
6,720,866 B1 4/2004 Sorrells et al.
6,774,782 B2 8/2004 Runyon et al.
6,825,754 B1 11/2004 Rolin
6,838,377 B2 1/2005 Tonami et al.
6,856,285 B2 2/2005 Bettin et al.
6,914,562 B2 7/2005 Forster
6,951,596 B2 10/2005 Green et al.
7,091,859 B2 * 8/2006 Duron et al. ..... 340/572.1
2001/0006368 A1 7/2001 Maloney
2001/0043162 A1 11/2001 Babb
2001/0053675 A1 12/2001 Plettner
2001/0054755 A1 12/2001 Kirkham
2002/0035701 A1 3/2002 Casebolt et al.
2002/0125566 A1 9/2002 Tonami et al.
2002/0126057 A1 9/2002 King et al.
2002/0145520 A1 10/2002 Maloney et al.
2002/0175873 A1 11/2002 King et al.
2003/0210188 A1 11/2003 Hebron et al.
2004/0001029 A1 1/2004 Parsche et al.
2004/0032330 A1 2/2004 Hoffman
2004/0032377 A1 2/2004 Forster et al.
2004/0046020 A1 3/2004 Andreasson et al.
2004/0046643 A1 3/2004 Becker et al.
2004/0059629 A1 3/2004 Luo et al.
2004/0066280 A1 4/2004 Pratt et al.
2004/0075607 A1 4/2004 Cathey
2004/0178912 A1 9/2004 Smith et al.
2006/0055542 A1 3/2006 Forster et al.

FOREIGN PATENT DOCUMENTS

DE 101 36 502 2/2003
EP 0 254 954 7/1987
EP 0 896 706 4/1997
GB 2293050 9/1995
WO WO 82/00541 2/1982
WO WO 93/05489 3/1993
WO WO 00/16277 3/2000
WO WO 00/16280 3/2000
WO WO 00/41148 7/2000
WO WO 00/43952 7/2000
WO WO 01/50547 7/2001
WO WO 01/61646 8/2001
WO WO 01/71686 9/2001
WO WO 01/73864 10/2001
WO WO 01/79988 10/2001
WO WO 01/80174 10/2001
WO WO 02/29929 4/2002
WO WO 02/097723 12/2002
WO WO 03/009007 1/2003
WO WO 2004/025554 3/2004
WO WO 2004/036689 4/2004
WO WO 2004/046762 6/2004
WO WO 2004/093246 10/2004
WO WO 2005/073937 1/2005

* cited by examiner

RFID DEVICES HAVING SELF-COMPENSATING ANTENNAS AND CONDUCTIVE SHIELDS

This is a continuation of International Application No. PCT/US04/11147, filed Apr. 12, 2004, published in English as WO 2004/093249, which is a continuation in part both of U.S. application Ser. No. 10/410,252, filed Apr. 10, 2003, now U.S. Pat. No. 6,914,562, and of U.S. application Ser. No. 10/700,596, filed Nov. 3, 2003, now U.S. Pat. No. 7,055,754 and which claims priority both from U.S. Provisional Application No. 60/517,148, filed Nov. 4, 2003, and from U.S. Provisional Application No. 60/537,483, filed Jan. 20, 2004. The above PCT application is hereby incorporated by reference in its entirety.

BACKGROUND OF THE INVENTION

1. Field of the Invention

This invention relates to the field of Radio Frequency Identification (RFID) tags and labels.

2. Description of the Related Art

There is no simple definition of what constitutes an antenna, as all dielectric and conductive objects interact with electromagnetic fields (radio waves). What are generally called antennas are simply shapes and sizes that generate a voltage at convenient impedance for connection to circuits and devices. Almost anything can act to some degree as an antenna. However, there are some practical constraints on what designs can be used with RFID tags and labels.

First, reciprocity is a major consideration in making a design choice. This means that an antenna which will act as a transmitter, converting a voltage on its terminal(s) into a radiated electromagnetic wave, will also act as a receiver, where an incoming electromagnetic wave will cause/induce a voltage across the terminals. Frequently it is easier to describe the transmitting case, but, in general, a good transmit antenna will also work well as a receive antenna (like all rules, there are exceptions at lower frequencies, but for UHF, in the 900 MHz band and above where RFID tags and labels commonly operate, this holds generally true).

Nevertheless, even given the above, it is difficult to determine what is a 'good' antenna other than to require that it is one that does what you want, where you want and is built how you want it to be.

However, there are some features that are useful as guides in determining whether or not an antenna is 'good' for a particular purpose. When one makes a connection to an antenna, one can measure the impedance of the antenna at a given frequency. Impedance is generally expressed as a composite of two parts; a resistance, R, expressed in ohms, and a reactance, X, also expressed in ohms, but with a 'j' factor in front to express the fact that reactance is a vector quantity. The value of jX can be either capacitive, where it is a negative number, or inductive, where it is a positive number.

Having established what occurs when one measures the impedance of an antenna, one can consider the effect of the two parts on the antenna's suitability or performance in a particular situation.

Resistance R is actually a composite of two things; the loss resistance of the antenna, representing the tendency of any signal applied to it to be converted to heat, and the radiation resistance, representing energy being 'lost' out of the antenna by being radiated away, which is what is desired in an antenna. The ratio of the loss resistance and the radiation resistance is described as the antenna efficiency. A low efficiency antenna, with a large loss resistance and relatively small radiation resistance, will not work well in most situations, as the majority of any power put into it will simply appear as heat and not as useful electromagnetic waves.

The effects of Reactance X are slightly more complex than that for Resistance R. Reactance X, the inductive or capacitive reactance of an antenna, does not dissipate energy. In fact, it can be lessened, by introducing a resonant circuit into the system. Simply, for a given value of +jX (an inductor), there is a value of −jX (a capacitor) that will resonate/cancel it, leaving just the resistance R.

Another consideration is bandwidth, frequently described using the term Q (originally Quality Factor). To understand the effect of bandwidth, it is not necessary to understand the mathematics; simply, if an antenna has a value of +jX or −jX representing a large inductance or capacitance, when one resonates this out it will only become a pure resistance over a very narrow frequency band. For example, for a system operating over the band 902 MHz to 928 MHz, if a highly reactive antenna were employed, it might only produce the wanted R over a few megahertz. In addition, high Q/narrow band matching solutions are unstable, in that very small variations in component values or designs will cause large changes in performance. So high Q narrowband solutions are something, in practical RFID tag designs, to be avoided.

An RFID tag, in general, consists of 1) an RFID chip, containing rectifiers to generate a DC power supply from the incoming RF signal, logic to carry out the identification function and an impedance modulator, which changes the input impedance to cause a modulated signal to be reflected; and, 2) an antenna as described above.

Each of these elements has an associated impedance. If the chip impedance (which tends to be capacitive) and the antenna impedance (which is whatever it is designed to be) are the conjugate of each other, then one can simply connect the chip across the antenna and a useful tag is created. For common RFID chips the capacitance is such that a reasonably low Q adequate bandwidth match can be achieved at UHF frequencies.

However, sometimes it is not so simple to meet operational demands for the tag due to environmental or manufacturing constraints, and then other ways of achieving a good match must be considered. The most common method of maintaining a desired impedance match, is to place between the antenna and chip an impedance matching network. An impedance matching network is usually a network of inductors and capacitors that act to transform both real and reactive parts of the input impedance to a desired level. These components do not normally include resistors, as these dissipate energy, which will generally lead to lower performance.

Difficulties can arise in impedance matching, because the impedance characteristics of an antenna may be affected by its surroundings. This may in turn affect the quality of the impedance matching between the antenna and the RFID chip, and thus the read range for the RFID tag.

The surroundings that may affect the characteristics of the antenna include the substrate material upon which the antenna is mounted, and the characteristics of other objects in the vicinity of the RFID tag. For example, the thickness and/or dielectric constant of the substrate material may affect antenna operation. As another example, placement of conducting or non-conducting objects near the tag may affect the operating characteristics of the antenna, and thus the read range of the tag.

An antenna may be tuned to have desired characteristics for any given configuration of substrate and objects placed around. For example, if each tag could be tuned individually to adjust the arm length and/or add a matching network, consisting of adjustable capacitors and inductors, the tag could be made to work regardless of the dielectric constant of the block. However, individual tuning of antennas would not be practical from a business perspective.

As discussed above, frequently designers optimize tag performance for 'free space', a datum generally given a nominal relative dielectric constant of 1. However, in the real world, the objects the labels are attached to frequently do not have a dielectric constant of 1, but instead have dielectric constants or environments of nearby objects that vary widely. For example, a label having a dipole antenna designed and optimized for 'free space' that is instead attached to an object having a dielectric constant that differs from that of 'free space,' will suffer a degraded performance, usually manifesting itself as reduced operational range and other inefficiencies as discussed above.

Therefore, while products having differing fixed dielectric constant substrates can be accommodated by changing the antenna design from the 'free space' design to incorporate the new dielectric constant or to compensate for other objects expected to be nearby the tag, this design change forces the tag manufacturer to produce a broader range of labels or tags, potentially a different type for each target product for which the tag may be applied, hence increasing costs and forcing an inventory stocking problem for the tag manufacturers.

When the tags are to be used on different types of materials that have a range of variable dielectric constants, the best design performance that can be achieved by the tag or label designer is to design or tune the tag for the average value of the range of dielectric constants and expected conditions, and accept degraded performance and possible failures caused by significant detuning in specific cases.

It will be appreciated that improvements would be desirable with regard to the above state of affairs.

SUMMARY OF THE INVENTION

According to one aspect of the present invention, an RFID device includes an antenna structure that includes compensating elements that compensate, at least to some degree, for changes of the operating characteristics of the antenna structure as the structure is placed on or in proximity to a dielectric material.

According to another aspect of the invention, an RFID device includes an antenna structure and a conductive plane or layer on opposite sides (faces) of a dielectric material.

According to yet another aspect of the invention, an RFID device includes: a dielectric layer; an antenna structure atop a first face of the dielectric layer; an RFID chip coupled to the antenna; and a conductive plane atop a second face of the dielectric layer, wherein the dielectric layer is interposed between the conductive plane and the antenna structure. The antenna structure includes one or more compensating elements that compensate at least in part for effects of the dielectric layer on operating characteristics of the antenna structure.

According to still another aspect of the invention, a method of configuring an RFID device includes the steps of: placing an antenna structure of the RFID device and a conducting plane of the RFID device opposed to one another on opposite sides of a dielectric layer; and re-tuning the antenna structure to compensate at least in part for effects of the dielectric layer on performance of the antenna structure.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which may not necessarily be to scale.

DETAILED DESCRIPTION

A radio frequency identification (RFID) tag includes an antenna configuration coupled to an RFID chip, such as in an RFID strap. The antenna configuration is mounted on one face (major surface) of a dielectric material, and includes compensation elements to compensate at least to some extent for various types of dielectric material upon which the antenna configuration may be mounted. In addition, a conductive structure, such a ground plane or other layer of conductive material, may be placed on a second major surface of the dielectric layer, on an opposite side of the dielectric layer from the antenna structure.

As discussed above, if each tag could be tuned individually, using variable capacitors and inductors, or by changing the arm length, the tag could be optimized to work for any specific dielectric material substrate. This cannot be done practically, but the antenna configuration can include compensation elements that have characteristics that change to some extent as a function of the dielectric substrate material and/or the environment of nearby objects, providing some compensation for changing characteristics of the antenna elements.

Figure 1:
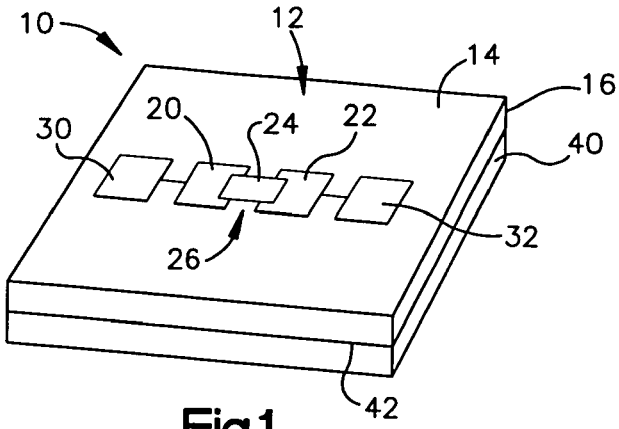
FIG. 1 is an oblique view of a radio frequency identification (RFID) device in accordance with the present invention.

Referring initially to FIG. 1, an RFID device 10 includes a compensating antenna configuration 12 on or atop a first face (major surface) 14 of a dielectric layer or substrate 16. The antenna configuration 12 includes a pair of antenna elements (conductive tabs) 20 and 22, which are coupled to an RFID chip 24. The RFID chip 24 may be part of an RFID strap 26, which for example includes conductive leads attached to the RFID chip 24. Examples of suitable RFID straps include an RFID strap available from Alien Technologies, and the strap marketed under the name I-CONNECT, available from Philips Electronics.

The compensating antenna configuration 12 also includes antenna compensation elements 30 and 32, which are coupled to or are a part of the antenna elements 20 and 22. The compensation elements 30 and 32 compensate to some extent for changes in operating characteristics of the antenna elements 20 and 22 due to the interaction of the antenna elements 20 and 22, and the dielectric material of the dielectric layer 16. The change in operating characteristics of the antenna elements 20 and 22 may manifest itself, for example, the antenna elements 20 and 22 becoming reactive; the radiation resistance of the antenna elements 20 and 22 changing, which may cause the antenna efficiency, expressed as the ratio of radiation resistance to the sum of loss resistance and radiation resistance, to drop; and, as a result of the above, the impedance match between the RFID chip 24 and antenna elements 20 and 22 may degrade, leading to mismatch loss and hence loss of optimum frequency operating range for the antenna structure. To mitigate these effects on the antenna elements 20 and 22, the compensating elements 30 and 32 may: 1) introduce an impedance matching network between the chip and antenna which impedance matches the two, maximizing power transfer between the chip 24 and the antenna elements 20 and 22; and/or 2) change the effective length of the antenna elements 20 and 22 so it stays at the resonant condition. These methods may be used separately, or may be used in combination to form a hybrid of the two. Various examples of compensating elements 30 and 32 are discussed below.

The RFID device 10 also includes a conductive structure or ground plane 40 on or atop a second major surface 42 of the dielectric layer 16 that is on an opposite side of the dielectric layer 16 than the first major surface 14. The dielectric layer 16 is thus between the conductive structure 40 and the antenna configuration 12. The conductive structure or ground plane 40 provides a "shield" to reduce or eliminate sensitivity of the RFID chip 24 and the antenna configuration 12 to objects on the other side of the ground plane 40. For example, the ground plane 40 may be on the inside of a carton or container that contains one or more objects. The objects may have any of a variety of properties that may affect operation of nearby unshielded RFID devices in different ways. For example, electrically conductive objects within a container, such as metal objects or objects in metal wrappers, may affect operation of nearby RFID devices differently than non-conductive objects. As another example, objects with different dielectric constants may have different effects on nearby RFID devices. The presence of the ground plane 40 between the antenna configuration 12 and RFID chip 24, and objects which may variably affect operation of the RFID device, may aid in reducing or preventing interaction of such objects and the working components of the RFID device 10.

The thickness or the dielectric characteristic of the dielectric layer 16 may be selected so as to prevent undesired interaction between the ground plane 40 and the antenna configuration 12. Generally, it has been found that at UHF frequencies, defined as a band in the range of 860 MHz to 950 MHz, a dielectric thickness of about 3 millimeters to 6 millimeters is suitable for a tag embodying the present invention. Likewise, a dielectric thickness of about 0.5 millimeter to about 3 millimeters is suitable for a tag designed to operate in a band centered on 2450 MHz. This range of thickness has been found to be suitable for efficient operation of the conductive tabs 20 and 22, despite the normally believed requirement for a separation distance of a quarter of a wavelength of the operating frequency between the antenna configuration 12 and the ground plane 40.

The ground plane 40 may be greater in extent than the operative parts of the RFID device 10 (the antenna configuration 12 and the RFID chip 24), so as to provide appropriate shielding to the operative parts of the RFID device 10. For example, the ground plane 40 may provide an overlap of the antenna configuration 12 of at least about 6 mm in every direction. However, it may be possible to make do with less overlap in certain directions, for example having less overlap at distal ends of the antenna elements 20 and 22, farthest from the RFID chip 24, than at the width of the antenna elements 20 and 22.

The RFID device 10 may be employed in any of a variety of suitable contexts. For example, the RFID device 10 may be a separate label affixed to a carton or other container or object, for instance by being adhesively adhered to the carton. The label may be placed on one side of the carton or within the object. Alternatively, one part of the RFID device may be adhesively attached to one side (one major face) of the carton (e.g., the ground plane attached to an inside of the carton) and another part of the RFID device (e.g., operative parts of the RFID device) may be adhesively attached to the other side (other major face) of the carton. Indeed, as explained further below, the RFID device may be a single label that wraps around an edge of a carton or other object, with the one part of the RFID device being on one part of the label, and the other part of the RFID device being on another part of the label, with part of the carton or other object being employed as a dielectric layer.

As another alternative, components of the RFID device 10 may be directly formed on sides of an object or portion of an object, such as on sides of a portion of a carton or other object. For example the antenna configuration 12 may be printed or otherwise formed on one side of a part of a carton or other object, and the ground plane 40 may be formed on a corresponding portion of an opposite side of the carton or other object.

What follows now are generalized descriptions of various types of compensation elements 30 and 32 that may be used as part of the compensation antenna configuration 12. It will be appreciated that compensation elements other that the precise types shown may be employed as the compensation elements 30 and 32.

Figure 2:
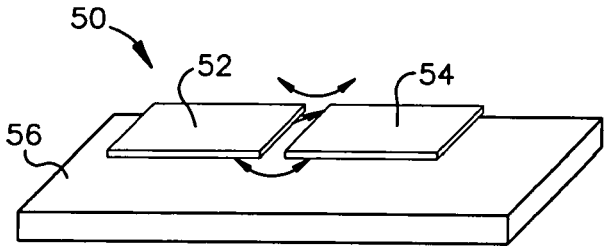
FIG. 2 is a plan view of capacitor shown mounted on a dielectric material.

One general type of compensation element 30, 32 is a capacitor 50, illustrated in FIG. 2. The capacitor 50 includes a pair of conductive plates 52 and 54 mounted or printed on a dielectric substrate 56. The capacitance between these plates is a function of the separation, size and, importantly, the dielectric constant of the substrate. In general, as the relative dielectric constant (Er) increases, so will the capacitance C between the plates.

Figure 3:
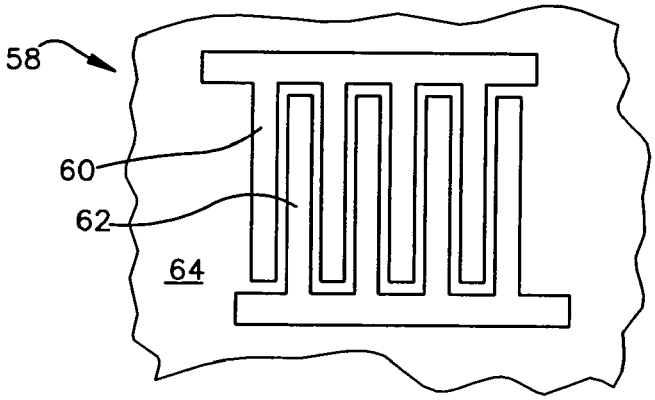
FIG. 3 is a plan view of one type of adaptive element in accordance with the present invention, an inter-digital capacitor.

One specific type of capacitor that embodies the present invention is shown in FIG. 3. The capacitor 58 shown there is formed by the cross coupling of electromagnetic fields formed between the capacitor "fingers" 60 and 62 on a dielectric 64. The capacitor 58 is referred to herein as an inter-digital capacitor. The capacitance and other characteristics of the capacitor 58 are generally a function of the spacing between the fingers 60 and 62, the number of fingers, the dimensions of the fingers 60 and 62, and the dielectric constant of the dielectric material 64, on which the capacitor 58 is attached.

Figure 4:
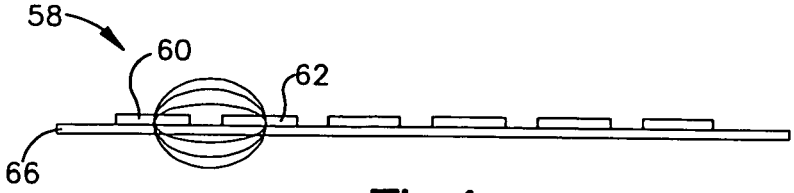
FIG. 4 is a cross-sectional view taken along the line 3-3 of FIG. 3 in the direction shown.
Figure 5:
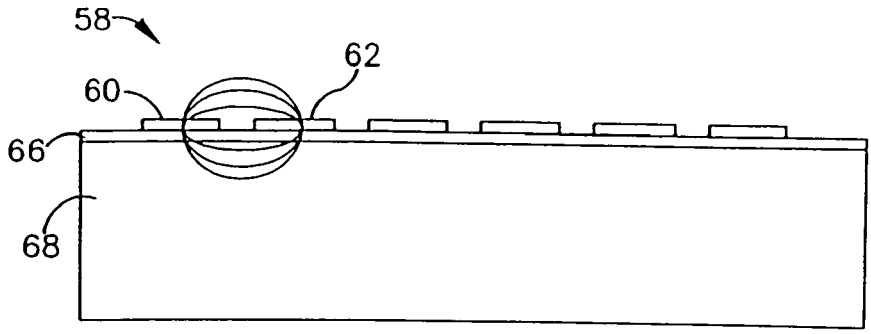
FIG. 5 is a cross-sectional view similar to that of FIG. 4 where the capacitor is mounted on a thicker material than that of the capacitor in FIG. 4.

FIGS. 4 and 5 illustrate the electric field around the capacitor 58 for two different dielectric substrates 64. FIG. 4 shows the capacitor 58 on a relatively thin substrate 66, such as a 100 μm polyester layer. FIG. 5 shows the capacitor 58 and the thin substrate 66 on a relatively thick substrate 68, such as a 30 mm thick dielectric block or slab having a dielectric constant between 2 and 7.

For the condition shown in FIG. 4, the inter-digital capacitor 58 is essentially in air, with the dielectric constant between the alternate fingers 60 and 62 being that of the thin substrate 66. Capacitance between fingers of the capacitor is a function of the dielectric constant around the fingers as the electric field spreads out, so it will have an initial value of $C_1$.

In the condition in FIG. 5, the electric field also is flowing in the block, and hence there is cross coupling between fingers of the capacitor. The capacitance $C_2$ is affected by the presence of the block, in particular by the dielectric constant of the material. Thus this arrangement comprises a component having a capacitance (C) that is a function of the relative dielectric constant of the block on which it is mounted, i.e., $C=f(E_r)$, where $E_r$ is the relative dielectric constant of the block. As the dielectric constant of the block increases, the capacitance increases. The component capacitance will also be a function of the block thickness as a thinner block will have less of an electromagnetic field in it, so will, for a given $E_r$, increase the capacitance by a lesser amount.

Figure 6:
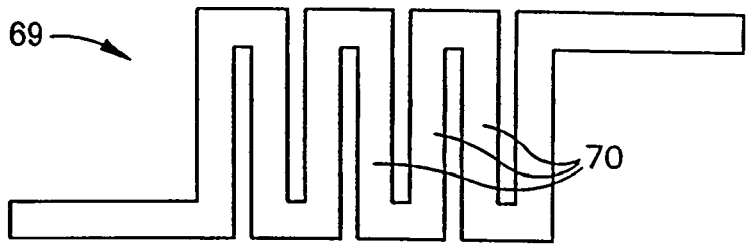
FIG. 6 is a plan view of another type of adaptive element in accordance with the present invention, a meander inductor.

FIG. 6 illustrates one possible inductor structure, a spiral or meander inductor 69 having a number of turns or other parts (meanders) 70 in close proximity to adjacent of the turns or other parts 70. This structure has a self-resonance, due to the capacitance between the turns. Hence the net inductance value can also be made a function of substrate $E_r$.

In air, this meander inductor component will have a certain value of inductance, L. When it placed on higher dielectric constant materials of significant thickness, the capacitive cross coupling between meanders increases, causing a reduction in overall inductance.

Figure 7:
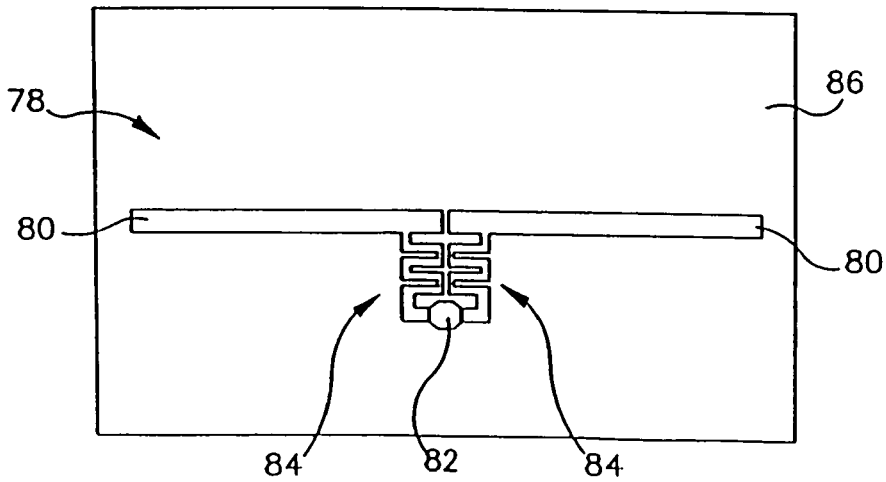
FIG. 7 is a plan view of an RFID tag structure embodying the present invention and using meander inductors.

FIG. 7 is a simplified illustration of how meander inductor components are used. A dipole antenna 78 with elements 80 is connected to an RFID chip 82 through meander inductors 84. The antenna 78, the inductors 84, and the chip 82 are attached to a thin dielectric material 86 (more precisely, a low dielectric constant substrate such as a 100 μm-thick polyester film) by being printed thereon, glued thereto, or mounted thereon in any of the customary ways.

Figure 8:
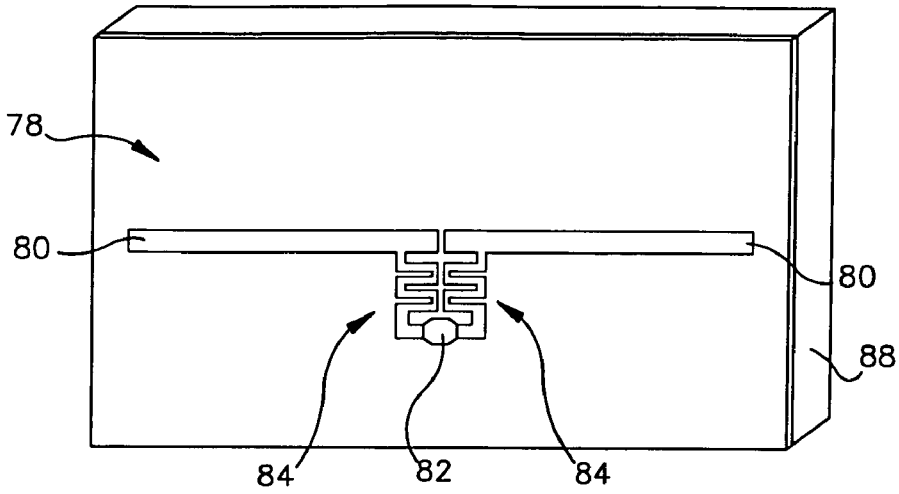
FIG. 8 is a plan view of an RFID tag structure embodying the present invention similar to that shown in FIG. 7, where the tag is mounted on a thicker material than that of the tag in FIG. 7.

FIG. 8 illustrates another configuration using the meander inductors 84, added between the dipole antenna 78 and chip 82. The dipole antenna 78, the chip 82, and the meander inductors 84 are all on a higher dielectric constant substrate 88.

If the basic dipole antenna 78 is sized for placement in air or on a low dielectric constant $E_r$ substrate, when the dipole antenna 78 is placed on a higher dielectric constant $E_r$ substrate 88, the antenna elements are too long at the chosen operating frequency. This manifests itself primarily by the antenna becoming inductive, that is, +jX increasing. Without compensation between the antenna 78 and the chip 82, the impedance match and hence tag performance would degrade. However, the meander inductors 84 have reduced the inductance on the higher dielectric constant $E_r$ substrate 88. The meander inductors 84 on the substrate 88 thus provide a smaller +jX to the circuit, so with proper selection of characteristics a good impedance match is maintained.

The single capacitive and inductive elements discussed above show the principle of a component's value being dependant on the characteristics of the substrate on which it is placed. A number of other components, which can be formed on a film next to an antenna that will react to the varying dielectric constant of the substrate material and its thickness, can be made, including multiple capacitors, inductors and transmission line elements (which can act as transformers), acting in parallel or series with one another to provide a substrate-dependant variable reactance. These substrate-dependant variable-reactance components can be used to retune and re-match the antenna/chip combination, to maintain performance for some antenna types over a certain range of substrate characteristics.

From the foregoing it has been established that surface features of a structure can react to or interact with the substrate upon which they are mounted, changing operating characteristics depending upon local environment, particularly upon the dielectric character of the substrate. However, using these components alone is not always the best solution. Another approach for the compensation elements 30 and 32 is for structures which change the effective length of antenna based on the environment in the vicinity of the compensation elements, particularly based on dielectric characteristics of the dielectric material upon which the compensation elements 30 and 32 are mounted. Some simple structures and methods of changing the effective length of antenna elements are now described.

Figure 9:
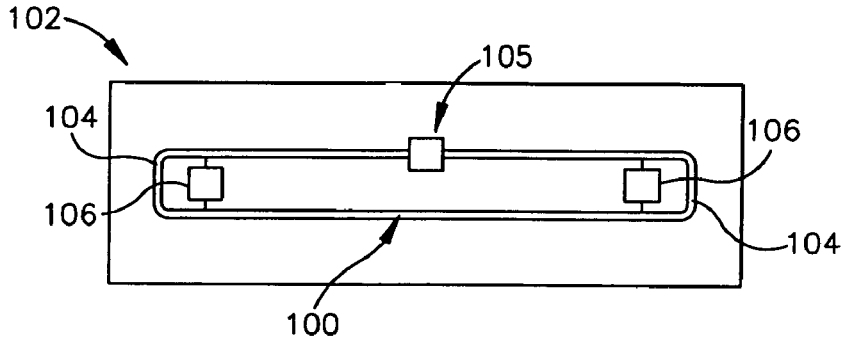
FIG. 9 is an RFID tag embodying the present invention and incorporating a folded dipole antenna structure.

For this purpose, one of the simplest antennas to consider will be a folded dipole 100, as illustrated as part of an RFID device 102, in FIG. 9. The total length of the loop 104 of the folded dipole antenna 100 is set to provide a good match to an RFID chip 105 at the minimum dielectric constant the tag is designed to operate with, as an example, a 30 mm block having a dielectric constant of $E_r$=2.

The adaptive elements 106 may include a printed series tuned circuit, consisting of an inductor, which is a simple meander of narrow line, and an inter-digital capacitor as discussed and illustrated previously. The value of the inductor and capacitor is such that, on materials having a dielectric constant of $E_r$=2, the resonance frequency is above 915 MHz, as the capacitor value is low. If the complete tag is placed on a 30 mm substrate having a dielectric constant of $E_r$=4, the correct length of the loop for the folded dipole is now shorter. However, the capacitor inside the adaptive element 106 may have increased in value, making the loop resonant at 915 MHz. The adaptive capacitive element now acts like a short circuit, providing a reduced length path for the RF current which is ideally exactly the path length to make the antenna correctly matched to the chip on materials having a dielectric constant of $E_r$=4. It will be appreciated that the values and numbers in the examples are intended for explaining general principles of operation, and do not necessarily represent real antenna and RFID tags designs.

This is an example using substrate properties as embodied in the present invention to adapt the effective length of an antenna. Alternately, distributed versions can be envisaged, where the inductance and capacitance are spread along the antenna length. It will appreciated that these capacitive and inductive elements may be used in series and/or parallel combinations and may potentially, combined with a antenna having appropriate characteristics, allow the impedance match to be adjusted as the substrate $E_r$ varies, to allow the antenna performance to be maintained.

An alternative structure is one where the compensating elements 30 and 32, such as the adaptive elements 106, adjust the effective length of the antenna. When an antenna is placed on or in a medium of a different $E_r$, the wavelength of a defined frequency changes. The ideal length for that antenna in the medium, to obtain a low or zero reactance and useful radiation resistance, would be shorter.

Therefore an antenna that reduces its effective length as the substrate dielectric constant varies would provide compensation. A concept for a structure that can achieve this is shown below in FIG. 10. This is a non-limiting example as a number of other suitable configurations are possible using various of the structures and methods described herein, alone or in combination with one another.

Figure 10:
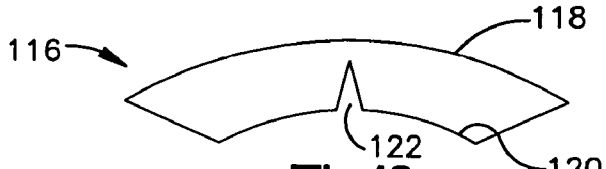
FIG. 10 is an antenna structure that embodies the present invention to reduce its effective length as the dielectric constant of the material on which it is mounted varies.

FIG. 10 is a plan view showing a curved section of a rectangular cross section conductor 116 designed to be placed on a substrate having any of a variety of values of $E_r$. This would form part of the two arms of a dipole antenna. More than one section may be used. The conductor 116 has potentially two paths for the current to flow: an outer curve 118 and an inner curve 120. The length of the transmission path is actually different between these two curves. The slit 122 acts as a capacitor. As the substrate $E_r$ increases in its dielectric constant value, the capacitance between the two radiating sections likewise increases, but the effective transmission path decreases in length.

It will be appreciated that many alternatives are possible for providing adaptive structures that are configured to compensate to some extent for different values of dielectric constant in a substrate to which the adaptive or compensating antenna structure is attached. For example, cross coupling between a simple wave format structure could also be designed to provide compensation. Cross-coupled structures have been described above.

Figure 11:
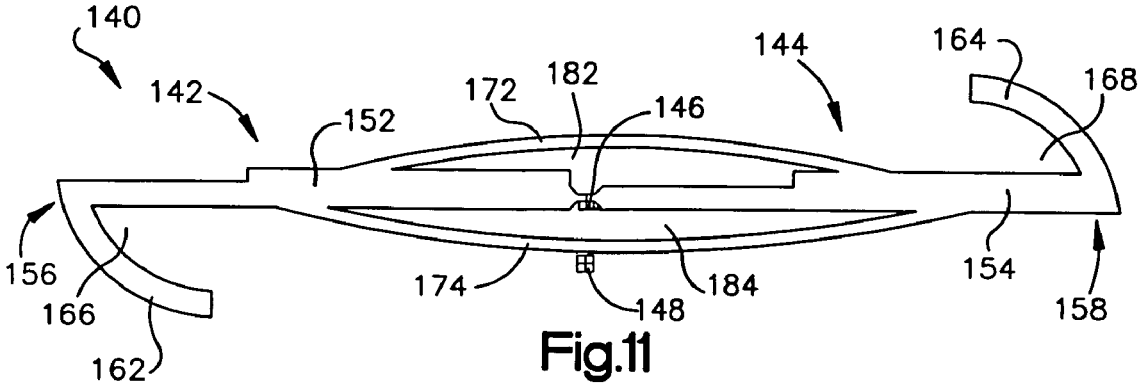
FIG. 11 is a plan view of one embodiment of an adaptive antenna structure in accordance with the present invention.

FIG. 11 shows an antenna structure 140 that includes some adaptive elements that are examples of compensating elements of some of the types discussed above. The antenna structure 140 includes a pair of antenna elements 142 and 144 that are coupled to an RFID chip or strap at respective attach points 146 and 148. The antenna elements 142 and 144 have respective main antenna lines 152 and 154. At the end of the main antenna lines 152 and 154 are capacitive stubs 156 and 158. The capacitive stubs 156 and 158 include respective conductive tails 162 and 164 that bend back toward the corresponding main antenna lines 152 and 154. Gaps 166 and 168 between the conductive tails 162 and 164, and the main antenna lines 152 and 154, widen further with further distance from the joinder of the conductive tails and the main antenna lines. The capacitive stubs 156 and 158 have variable characteristics, depending on the dielectric constant of the substrate to which the antenna structure 140 is attached. More particularly, the capacitance between the conductive tails 162 and 164 and the main antenna lines 152 and 154, respectively, is a function of the dielectric constant of the substrate material upon which the antenna structure 140 is mounted.

The antenna structure 140 also includes loop lines 172 and 174 on either side of the main antenna lines 152 and 154. As shown, the loop lines 172 and 174 are narrower than the main antenna lines 152 and 154. Each of the loop lines 172 and 174 is coupled to both of the main antenna lines 152 and 154. There is a gap 182 between the loop line 172 and the main antenna lines 152 and 154. A corresponding gap 184 is between the loop line 174 and the main antenna lines 152 and 154. The gaps 182 and 184 have variable thickness, being narrow where the loop lines 172 and 174 join with the main antenna lines 152 and 154, and widening out toward the middle of the loop lines 172 and 174. The loop lines 172 and 174 function as inductors in the absence of a ground plane on an opposite side of the dielectric substrate layer. With a ground plane, such as the ground plane 40 (FIG. 1) described above, on the other side of the dielectric layer, the loop lines 172 and 174 may function as microstrip lines, improving the impedance match between the antenna structure 140 and the RFID chip or strap coupled to the antenna structure 140.

Figure 12:
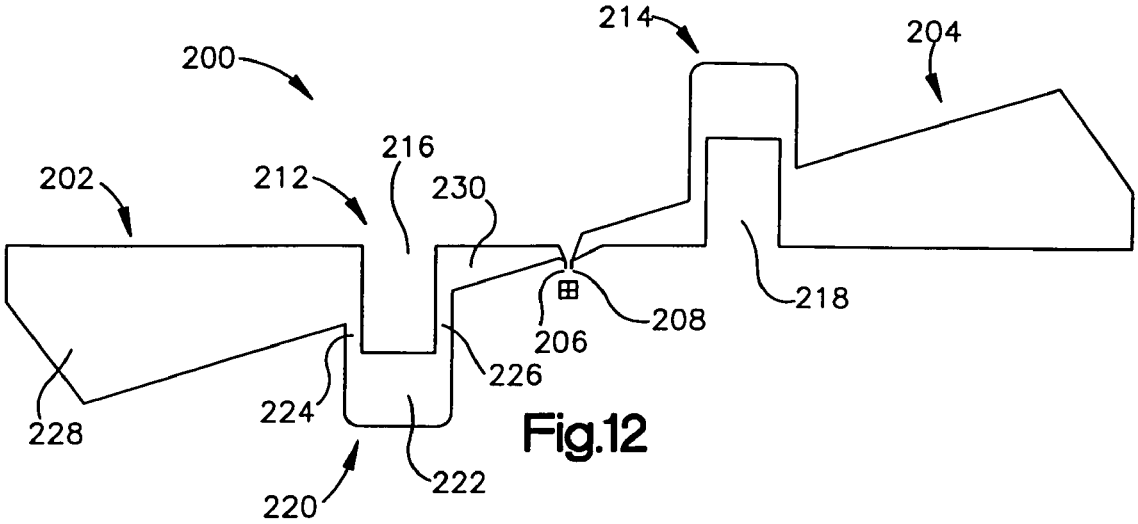
FIG. 12 is a plan view of another embodiment of an adaptive antenna structure in accordance with the present invention.

FIG. 12 shows an alternate antenna structure 200 having a pair of generally triangular antenna elements (conductive tabs) 202 and 204. The antenna elements 202 and 204 have attachment points 206 and 208 for coupling an RFID chip or strap to the antenna structure 200.

The antenna elements 202 and 204 have respective compensation or adaptive portions or elements 212 and 214. The adaptive portions 212 and 214 provide gaps 216 and 218 in the generally triangular conductive tabs. On one side of the gap 216 is a conductive link 220, including a relatively wide central portion 222, and a pair of relatively narrow portions 224 and 226 along the sides of the gap 216, coupling the central portion 222 to the parts 228 and 230 of the antenna element 202 on either side of the gap 216. The central portion 222 may have a width approximately the same as that of the antenna element parts 228 and 230 in the vicinity of the gap 216. The narrow portions 224 and 226 may be narrower than the central portion 222 and substantially all of the antenna element parts 228 and 230. The antenna element 204 may have a conductive link 234, substantially identical to the conductive link 220, in the vicinity of the gap 218.

The antenna structure 200 has been found to give good performance when mounted on walls of cardboard cartons filled with a variety of different products containing both conductive and non-conductive materials. The antenna structure 200, and in particular the adaptive portions 212 and 214, may provide compensation for various environments encountered by the antenna structure 200, for example including variations in substrate characteristics and variations in characteristics of nearby objects. The antenna structure 200 may be used with or without a conductive structure or ground plane on an opposite side of a dielectric substrate, such as a cardboard carton wall, to which the antenna structure is mounted. For example, the antenna structure 200 may be mounted onto a cardboard container 3-4 mm thick.

As discussed above, the various adaptive or compensating antenna structures described herein may be employed with an overlapping ground plane for use providing some measure of shielding, to at least reduce the effect of nearby objects on operations of RFID devices containing the antenna structures. However, it will be appreciated that some or all of the antenna structures may be used without a corresponding ground plane.

What is now described are various configurations involving conductive structures such as ground planes. Also described are some configurations of antenna elements (conductive tabs) that have been found to be effective in combination with ground planes, although it will be appreciated that other configurations of antenna elements may be used with ground planes. It will be appreciated that the above-described adaptive elements may be suitably combined with the below-described ground planes, methods and configurations.

As an overview, a radio frequency identification device (RFID) and its antenna system may be attached to a package or container to communicate information about the package or container to an external reader. The package may be an individual package containing specific, known contents, or an individual, exterior package containing within it a group of additional, interior individual packages. The word "package" and "container" are used interchangeably herein to describe a material that houses contents, such as goods or other individual packages, and equivalent structures. The present invention should not be limited to any particular meaning or method when either "package" or "container" is used.

As noted above, an RFID device may include conductive tabs and a conductive structure, with a dielectric layer between the conductive tabs and the conductive structure. The conductive structure overlaps the conductive tabs and acts as a shield, allowing the device to be at least somewhat insensitive to the surface upon which it is mounted, or to the presence of nearby objects, such as goods in a carton or other container that includes the device. The dielectric layer may be a portion of the container, such as an overlapped portion of the container. Alternatively, the dielectric layer may be a separate layer, which may vary in thickness, allowing one of the conductive tabs to be capacitively coupled to the conductive structure. As another alternative, the dielectric layer may be an expandable substrate that may be expanded after fabrication operations, such as printing.

Figure 13:
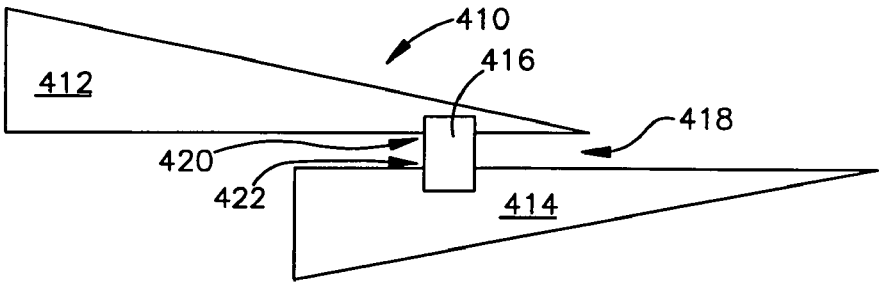
FIG. 13 is a schematic diagram of an RFID tag incorporating an antenna arrangement in accordance with the present invention.

FIG. 13 illustrates an RFID tag 410 that includes a wireless communication device 416. The device 416 may be either active in generating itself the radio frequency energy in response to a received command, or passive in merely reflecting received radio frequency energy back to an external originating source, such as current RFID tag readers known in the art.

In this embodiment, there are at least two conductive tabs 412 and 414, coupled to the wireless communication device for receiving and radiating radio frequency energy received. The tabs 412 and 414 together form an antenna structure 417. The two tabs 412 and 414 are substantially identical in shape and are coupled to the wireless communication device 416 at respective feedpoints 420 and 422 that differ in location relative to each of the tabs 412 and 414. The tabs 412 and 414 may be generally identical in conducting area if the two tabs are of the same size as well as shape. Alternatively the tabs 412 and 414 may differ in size while their shape remains generally the same resulting in a different conducting area. The tabs 412 and 414 may be collinear or non-collinear to provide different desired antenna structures. For example, in FIG. 13 tabs 412 and 414 are offset and adjacent to provide a slot antenna system in area 418 that provides for resonance at multiple radiating frequencies for operation at multiple frequencies.

It is also contemplated that the invention includes having multiple arrays of conductive tabs that are connected to device 416. These tabs may be designed to work in unison with one another to form dipole or Yagi antenna systems, or singly to form monopole antennas as desired for the particular tag application. By using such multiple conductive tab arrays, multiple resonant frequencies may be provided so that the tag may be responsive to a wider range of tag readers and environmental situations than a single dedicated pair of conductive tabs.

Figure 14:
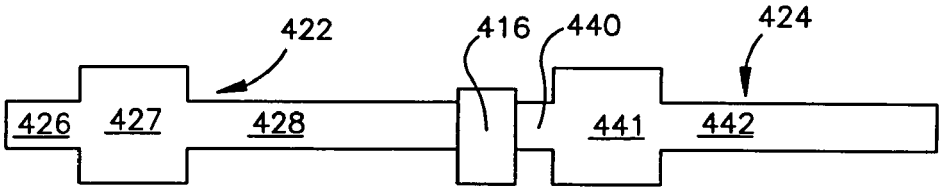
FIG. 14 is a schematic diagram of an RFID tag incorporating an alternative antenna arrangement in accordance with the present invention.
Figure 15:
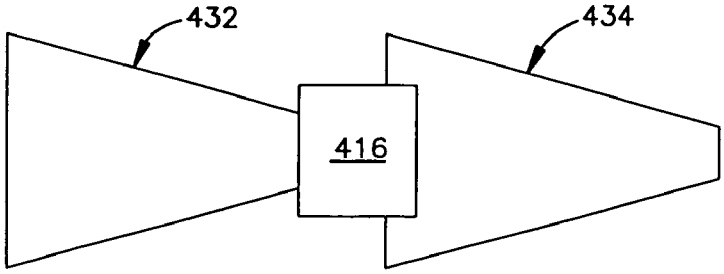
FIG. 15 is a schematic diagram of an RFID tag incorporating a second alternative antenna arrangement embodying the present invention.

Other considered shapes for the conductive tabs are illustrated in FIGS. 14 and 15, and include not only regular shapes such as the tapered, triangular shape illustrated in FIG. 13, but also truncated triangular shapes denoted by reference numbers 432 and 434 in FIG. 15.

Rectangular shaped conductive tabs are also included in this invention as illustrated in FIG. 14 as reference numbers 422 and 424. In fact, FIG. 14 illustrates, for example, that the tabs may include a series of contiguous rectangular portions 426, 427, 428 and 440, 441, 442.

In one embodiment of the invention, the rectangular portions shown in FIG. 14 will have dimensions substantially as follows: Rectangular portion 426 is about 3 millimeters wide by about 3 millimeters long; contiguous rectangular portion 427 is about 10 millimeters wide by about 107.6 millimeters long; and, rectangular portion 428 is about 3 millimeters wide by 15.4 millimeters long. With these dimensions, it is further preferred that the dielectric substrate have a thickness between the conductive tabs and the ground plane of about 6.2 millimeters for foam. Likewise, the ground plane for this preferred embodiment is about 16 millimeters wide by about 261 millimeters long.

The conductive tabs may also have irregular shapes, or even composite shapes that include both regular and irregular portions. Other alternative antenna systems that embody the present invention include those that have tabs with a triangular portion contiguous with a freeform curve or a regular curve such as a sinusoidal pattern.

In FIG. 13, the tab feedpoints 420 and 422, may be selected so that the impedance across the two feedpoints 420 and 422 of tabs 412 and 414, respectively, is a conjugate match of the impedance across the wireless communication device 416 to allow for a maximum transfer of energy therebetween.

In general, a method of selecting feedpoints on the tabs to achieve this conjugate impedance match, may be to select points on each tab differing in location where the width profile of each tab, taken along an axis transverse to the longitudinal centerline axis of each tab, differs from one another. That is, the feedpoints 420 and 422 may be selected such that the width of the tabs 412 and 414 at the feedpoints 420 and 422, taken along the centerline of the tab as you move away from the center of the tag where it connects to the communications device, measured against the length, differs between the two tabs 412 and 414. By choosing such points, either by calculation or trial and error, a conjugate impedance match can be achieved.

Specifically, with reference to the Figures, the longitudinal centerline axis of a tab is seen to be a line that remains equidistant from opposite borders or edges of the tab and extending from one end of the tab to the other. At times with regular shaped tabs, this longitudinal centerline axis will be a straight line similar to a longitudinal axis of the tab. At other times, with irregular shaped tabs, the longitudinal centerline axis will curve to remain equidistant from the borders. It is also seen that this longitudinal centerline axis is unique to each tab. The width of the tab is determined along an axis transverse to the longitudinal centerline axis and will be seen to be dependent upon the shape of the tab. For example, with a rectangular shaped tab, the width will not vary along the longitudinal centerline axis, but with a triangular or wedge shaped tab, the width will vary continuously along the longitudinal centerline axis of the tab. Thus, while it is contemplated that the present invention includes tabs having rectangular shaped portions, there will also be portions having different widths.

Another method of selecting the feedpoints on the conductive tabs, is to select a feedpoint differing in location on each of the tabs where the conducting area per unit length of the longitudinal centerline axis of each tab varies with distance along the longitudinal centerline axis of each of said tabs from its feedpoint. In essence, this method selects as a feedpoint a location on each tab where the integrated area of the shape per unit length of the centerline varies and is not necessarily the width of the tab.

Figure 16:
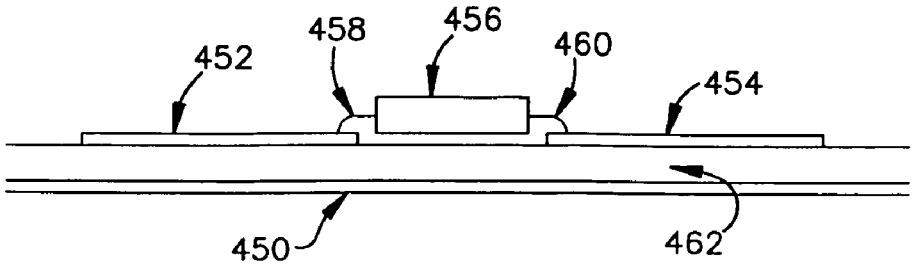
FIG. 16 is a cross sectional view of an RFID tag incorporating an antenna arrangement in accordance with the present invention, mounted on a packaging sidewall.

FIG. 16 illustrates how a radio frequency reflecting structure or ground plane 450 is operatively coupled to tabs 452 and 454, for reflecting radio frequency energy radiated from the tabs 452 and 454. The ground plane elements may be substantially the same size as the conductive tabs or greater, so that the ground plane elements may effectively reflect radio frequency energy. If the ground plane elements are substantially smaller than the conductive tabs, the radio frequency energy will extend beyond the edges of the ground plane elements and interact with the contents of the packaging causing deterioration in the operating efficiency of the label. In one embodiment, the ground plane 450 may extend at least about 6 mm beyond the boundary of the tabs 452 and 454.

In the illustrated embodiment the wireless communication device 456 is connected at feedpoints 458 and 460 to the tabs 452 and 454. This structure 450 may be a simple ground plane made from a single, unitary plate or a complex reflecting structure that includes several isolated plates that act together to reflect radio frequency energy. If the antenna structure is located on one side of a package wall 462, the radio frequency reflecting structure 450 may be on the opposite side of the same wall 462 using the wall itself as a dielectric material as described further below.

As indicated above, a dielectric material is preferably located intermediate the conductive tabs 452 and 454, and the radio frequency reflecting structure 450. An example of such a dielectric material is the packaging wall 462 described above. The thickness or the dielectric characteristic of the dielectric intermediate the tabs and radio frequency reflecting structure may be varied along a longitudinal or transverse axis of the tabs. Generally, it has been found that at UHF frequencies, defined as a band in the range of 860 MHz to 950 MHz, a dielectric thickness of about 3 millimeters to 6 millimeters is suitable for a tag embodying the present invention. Likewise, a dielectric thickness of about 0.5 millimeter to about 3 millimeters is suitable for a tag designed to operate in a band centered on 2450 MHz. This range of thickness has been found to be suitable for efficient operation of the conductive tabs despite the normally believed requirement for a separation distance of a quarter of a wavelength of the operating frequency between the radiating element and ground plane.

With the present invention advantages have been found in both manufacturing and application of the labels in that a thinner, lower dielectric material may be used in label construction, as well as the fact that shorter tabs may be utilized resulting in a manufacturing savings in using less ink and label materials in constructing each label and in increasing the label density on the web medium during manufacturing making less wasted web medium. Also such thinner and smaller labels are easier to affix to packaging and less likely to be damaged than those thicker labels that protrude outwardly from the packaging surface to which they are attached.

Another embodiment is directed toward the antenna structure itself as described above without the wireless communication device.

Figure 17:
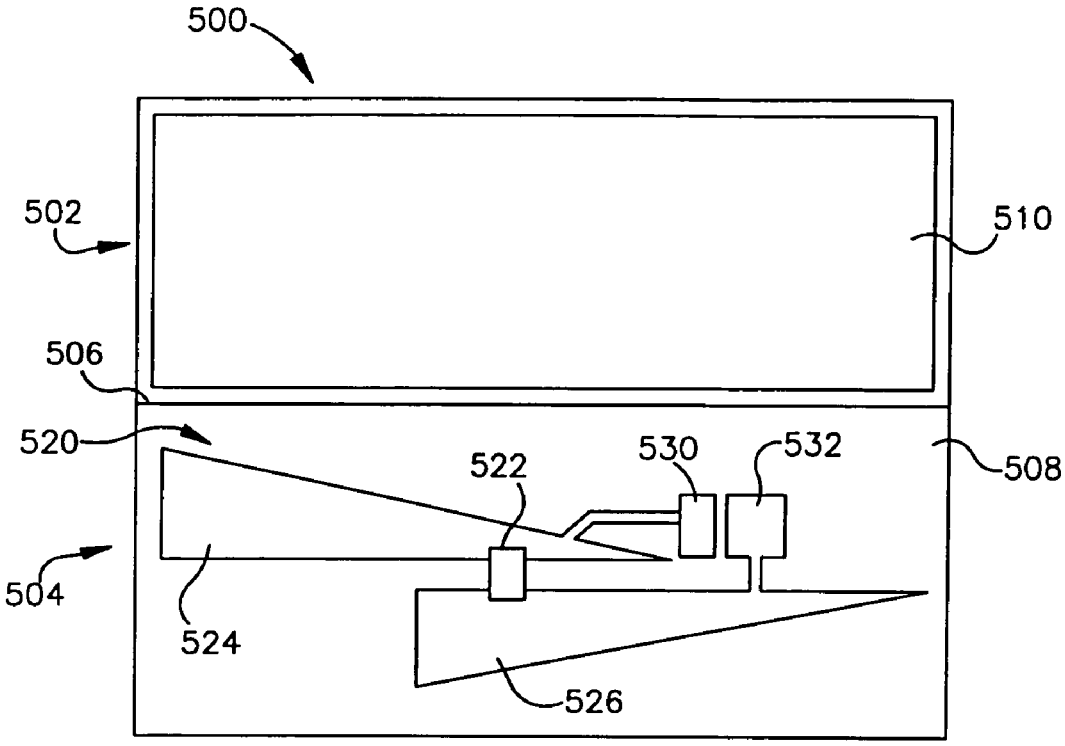
FIG. 17 is a plan view of another embodiment RFID device in accordance with the present invention, capable of being wrapped over an edge of a carton or other object.

FIG. 17 illustrates an RFID device 500 configured to be placed over the edge of an object, such as the edge of a cardboard carton. The RFID device 500 is a label in two sections 502 and 504, with a boundary 506 therebetween. The sections 502 and 504 may include a single substrate 508, which may have a suitable adhesive backing, such as a suitable pressure-sensitive adhesive.

The first section 502 has a conductive ground plane 510 printed or otherwise formed upon the substrate 508. The ground plane 510 may be formed from conductive ink.

The second section 504 includes an antenna structure 520 printed or formed on the substrate 508, and an RFID chip or strap 522 coupled to the antenna structure 520. The antenna structure 520 may include antenna elements 524 and 526, which may be similar to the antenna elements (conductive tabs) discussed above, and adaptive or compensating elements 530 and 532. The adaptive or compensating elements 530 and 532 may include one or more of the types of adaptive or compensating elements discussed above.

Figure 18:
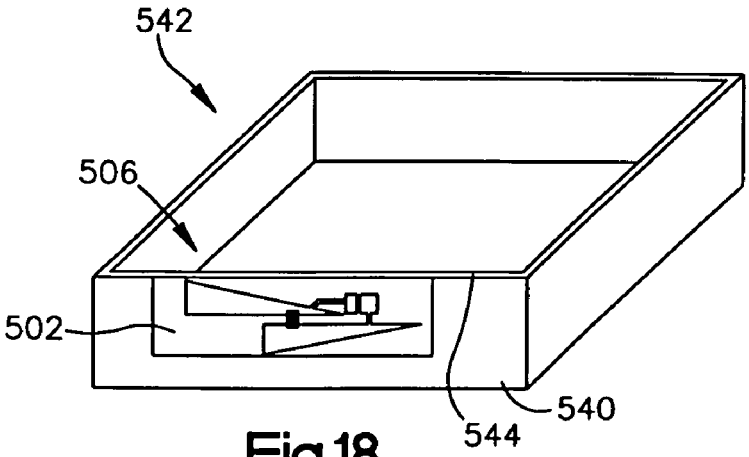
FIG. 18 is an oblique view showing the RFID device of FIG. 17 installed on a carton.
Figure 19:
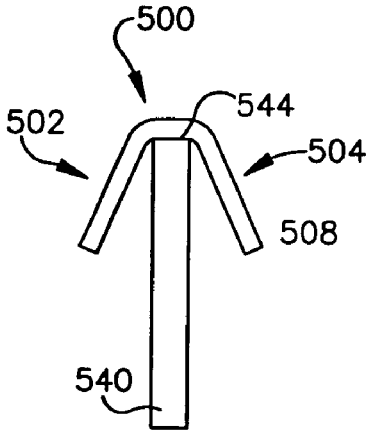
FIG. 19 is a cross-section view showing the RFID device of FIG. 17 installed on the edge of an object such as a carton.

FIGS. 18 and 19 illustrate installation of the RFID device 500 on a panel 540 of an object 542, such as a cardboard container. The RFID device 500 is folded over an edge 544 of the panel 540, with the first section 502 on the inside of the panel 540 and the second section 504 on the outside of the panel 540. The boundary 506 between the two sections 502 and 504 is approximately placed along the edge 544 of the panel 540. Since the RFID device 500 is on a single substrate 508, folding the device 500 to place the sections 502 and 504 on opposite sides of the panel 540 provides some measure of alignment between the ground plane 510 and the antenna structure 520. It will be appreciated that the ground plane 510 may have an increased amount of overlap to compensate for possible misalignment between the ground plane 510 and the antenna structure 520 in the adhering of the RFID device 500 to the panel 540.

The adaptive elements 530 and 532 may provide compensation for variations that may be encountered in the objects the RFID device 500 is applied to. Such variations may be due, for example, to variations in container material thickness and/or dielectric characteristics.

It will be appreciated that many variations are possible for the configuration of the RFID device 500. For example, it may be possible to utilize other types of antenna elements, described below and above, as an alternative to the triangular antenna elements 524 and 526.

Figure 20:
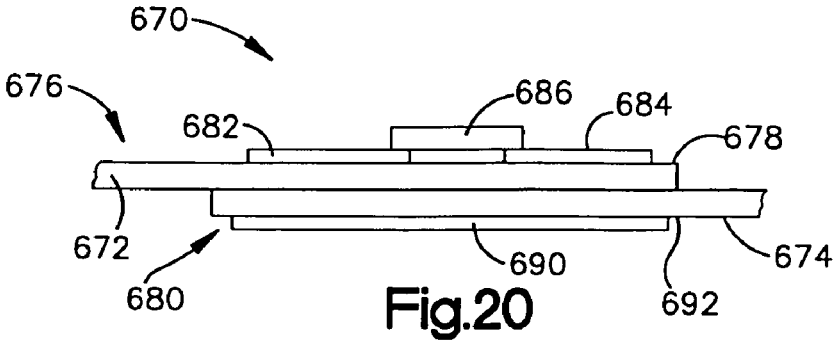
FIG. 20 is a cross sectional view of an RFID device of the present invention mounted on an overlapping portion of a carton.

Turning now to FIG. 20, an RFID device 670 is illustrated mounted on parts 672 and 674 of a carton 676. The device 670 is located on an overlapping portion 680 of the carton 676, where the parts 672 and 674 overlap one another. The parts 672 and 674 may be adhesively joined in the overlapping portion. Alternatively, the parts 672 and 674 of the carton 676 may be joined by other means, such as suitable staples or other fasteners. On one side or major face 678 of the overlapping portion 680 are conductive tabs 682 and 684, and a wireless communication device 686, such as an RFID chip or strap. A radio frequency reflecting structure or ground plane 690 is on an opposite side or major face 692 of the overlapping portion 680.

The overlapping portion 680 of the carton 676 thus functions as a dielectric between the conductive tabs 682 and 684, and the wireless communication device 686. Performance of the RFID device 670 may be enhanced by the additional thickness of the overlapping portion 680, relative to single-thickness (non-overlapped) parts of the carton parts 672 and 674. More particularly, utilizing a double-thickness overlapped carton portion as the dielectric for an RFID device may allow for use of such devices on cardboard cartons having thinner material. For example, some cartons utilize a very thin cardboard, such as 2 mm thick cardboard. A single thickness of 2 mm thick cardboard may be unsuitable or less suitable for use with surface-insensitive RFID device such as described herein.

The RFID device 670 shown in FIG. 20 may be produced by printing conductive ink on the opposite sides (major faces) 678 and 692 of the overlapping portion 680, to form the conductive tabs 682 and 684, and the reflecting structure 690. It will be appreciated that a variety of suitable printing methods may be used to form the tabs 682 and 684, and the reflecting structure 90, including ink jet printing, offset printing, and Gravure printing.

The wireless communication device 686 may be suitably joined to the conductive tabs 682 and 684 following printing of the conductive tabs 682 and 684. The joining may be accomplished by a suitable roll process, for example, by placing the communication device 686 from a web of devices onto the tabs 682 and 684.

It will appreciated that the printing may be performed before the carton parts 672 and 674 are overlapped to form the overlapping portion 680, or alternatively that the printing may in whole or in part be performed after formation of the overlapping portion 680. The conductive ink may be any of a variety of suitable inks, including inks containing metal particles, such as silver particles.

It will be appreciated that formation of the conductive tabs 682 and 684, and/or the reflective structure 690 may occur during formation of the carton parts 672 and 674, with the conductive tabs 682 and 684 and/or the reflective structure 690 being for example within the carton parts 672 and 674. Forming parts of the RFID device 670 at least partially within the carton parts 672 and 674 aids in physically protecting components of the RFID device 670 from damage. In addition, burying some components of the RFID device 670 aids in preventing removal or disabling of the RFID device 670, since the RFID device 670 may thereby be more difficult to locate.

Figure 21:
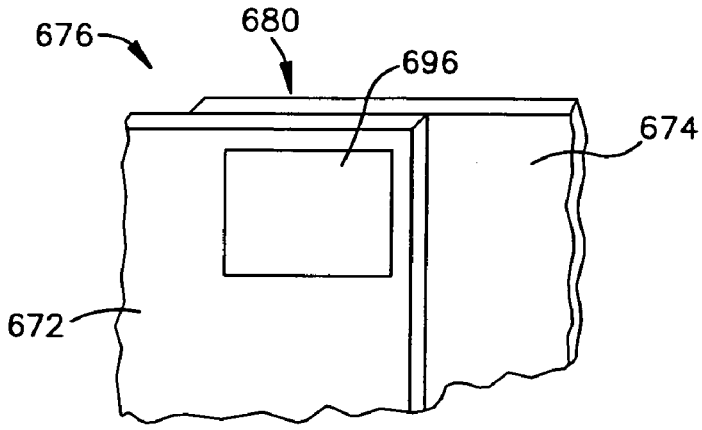
FIG. 21 is an oblique view of a marker printed on a portion of a carton or other container, indicating where a reflective conductive structure is to be located.
Figure 22:
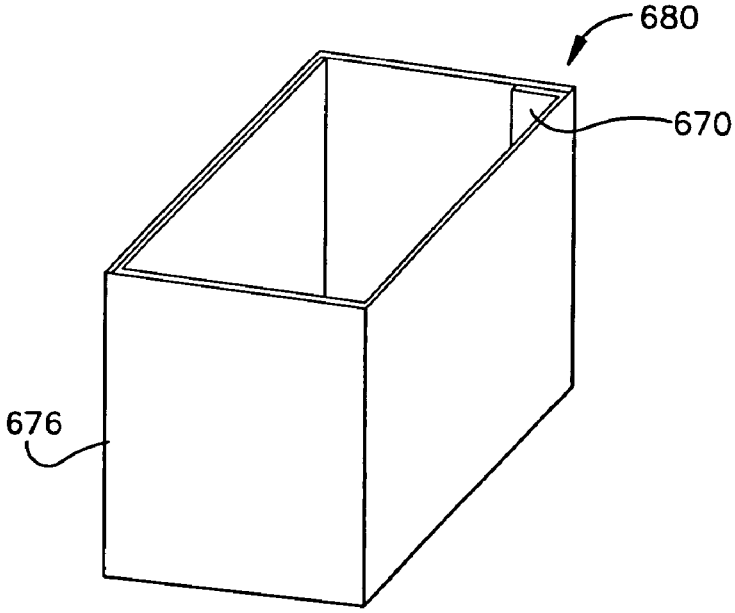
FIG. 22 is an oblique view illustrating placement of the RFID device of FIG. 21.

In one embodiment, the conductive tabs 682 and 684 may be printed onto the interior of the carton parts 672. As illustrated in FIG. 21, a marker 696 may be printed or otherwise placed on one of the carton parts 672 and 674 to indicate where the reflective structure 690 is subsequently to be placed.

The conductive tabs 682 and 684 may have any of the suitable shapes or forms described herein. Alternatively, the conductive tabs 682 and 684 may have other forms, such as shapes that are asymmetric with one another. The conductive tabs 682 and 684 may have configurations that are tunable or otherwise compensate for different substrate materials and/or thicknesses, and/or for other differences in the environment encountered by the RFID device 670, such as differences in the types of contents in a carton or other container on which the RFID device 670 is mounted.

Figure 23:
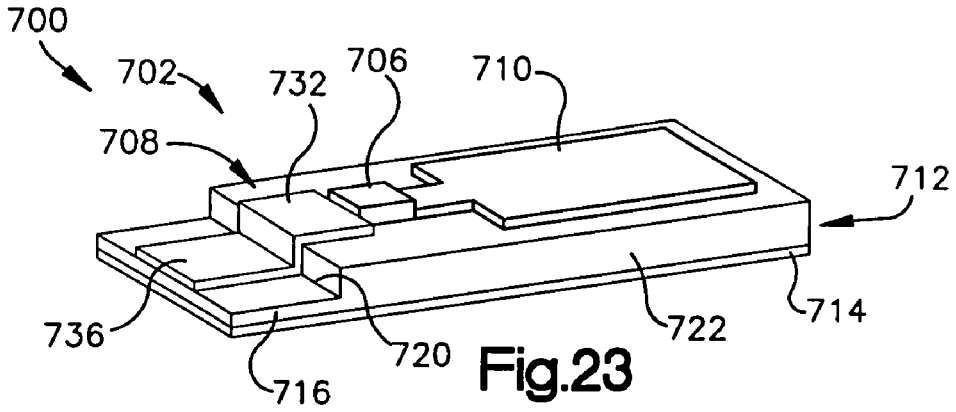
FIG. 23 is an oblique view of an RFID device in accordance with the present invention, having a monopole antenna structure.

The RFID devices 670 illustrated in FIGS. 20 and 21 enable mounting of devices on a wider range of packaging materials, with the reflective structure 690 providing a "shield" to reduce or prevent changes in operation of the RFID device 670 due to differences in the types of merchandise or other material stored in a carton or other container upon which the RFID device 670 is mounted. As illustrated in FIG. 23, the RFID device 670 may be located on a carton or other container 698, oriented so that the reflective structure 690 is interposed between the conductive tabs 682 and 684, and the interior of the container 698.

FIG. 23 shows the operative components of another embodiment RFID device, an RFID device 700 having an essentially monopole antenna structure 702. The RFID device 700 includes a wireless communication device 706 (e.g., a strap) that is coupled to a pair of conductive tabs 708 and 710 that are mounted on a substrate 712, with a reflective structure or ground plane 714 on an opposite side of the substrate 712 from the conductive tabs 708 and 710.

At least part of one of the conductive tab 708 is capacitively coupled to the reflective structure 714, by being mounted on a thinner portion 716 of the substrate 712, which has a thickness less than that of the portion of the substrate 712 underlying the conductive tab 710. It will be appreciated that, with proper attention to matching, electrically coupling the tab 708 to the conductive reflective structure 714, allows operation of the RFID device 700 as a monopole antenna device. The relative thinness of the thinner portion 716 facilitates capacitive electrical coupling between the conductive tab 708 and the conductive reflective structure 714.

The conductive tab 710 functions as a monopole antenna element. The conductive tab 710 may have a varying width, such as that described above with regard to other embodiments.

The matching referred to above may include making the relative impedances of the antenna structure 102 and the wireless communication device 106 complex conjugates of one another. In general, the impedance of the antenna structure 102 will be a series combination of various impedances of the RFID device 100, including the impedance of the conductive tab 108 and its capacitive coupling with the reflective structure 114.

The thinner portion 716 may be made thinner by inelastically compressing the material of the substrate 712. For example the substrate 712 may be made of a suitable foam material, such as a suitable thermoplastic foam material, which may be a foam material including polypropylene and/or polystyrene. A portion of the substrate 712 may be compressed by applying sufficient pressure to rupture cells, causing the gas in the cells to be pressed out of the foam, thereby permanently compressing the foam.

The compressing described above may be performed after the formation of the tabs 708 and 710 on the substrate 712. The pressure on the tab 708 and the portion of the substrate 712 may be directed downward and sideways, toward the center of the RFID device 700, for example where the wireless communication device 706 is mounted. By pressing down and in on the conductive tab 708 and the substrate 712, less stretching of the material of the conductive tab 708 occurs. This puts less stress on the material of the conductive tab 708, and may aid in maintaining integrity of the material of the conductive tab 708.

As an alternative, it will be appreciated that the conductive tabs 708 and 710 may be formed after compression or other thinning processes to produce the thinned portion 716 of the substrate 712. The conductive tabs 708 and 710 may be formed by suitable processes for depositing conductive material, such as by printing conductive ink.

With reference again to FIG. 23, the substrate 712 may have a sloped region 720 between its thicker portion 722 and the thinner portion 716. The sloped region 720 may aid in reducing stresses on the conductive tab 708 when the conductive tab 708 is placed prior to compressing of the thinner portion 716, by increasing the area of the conductive tab 708 that is under stress. When the thinner portion 716 is compressed prior to printing or other depositing of the conductive tab 708, the sloped region 720 may aid in ensuring conduction between a first part 732 of the conductive tab 708 that is on the thicker portion 722 of the substrate 712, and a second part 736 of the conductive tab 708 that is on the thinner portion 716 of the substrate 712.

It will be appreciated that a variety of suitable methods may be utilized to produce the thinner portion 716 of the substrate 712. In addition to the compressing already mentioned above, it may be possible to heat a portion of the substrate, either in combination with compression or alone, to produce the thinner portion 716. For example, a thermoplastic foam material may be heated and compressed by running it through a pair of rollers, at least one of which is heated. The thermoplastic film may be compressed over an area, and turned into a solid thermoplastic sheet, thus both reducing its thickness and increasing its dielectric constant. Alternatively, material may be removed from a portion of the substrate 712, by any of a variety of suitable methods, to produce the thinner portion 716.

As suggested above, the proximity of the second conductive tab part 736 to the conducting reflective structure 714, with only the thinner portion 716 of the substrate 712 between, aids in capacitively coupling the second part 736 and the reflective structure 714. In a specific example, a 3.2 mm thick foam dielectric was compressed over a 20 mm×10 mm area, to a thickness of 0.4 mm. This raised the dielectric constant of the plastic foam material from 1.2 to 2.2. Therefore, due to the reduced thickness of the foam and the increased dielectric constant of the substrate material in the thinner portion 716, the total capacitance was increased from 0.66 pF to 9.7 pF, which has a reactance of 17.8 ohms at 915 MHz.

Figure 24:
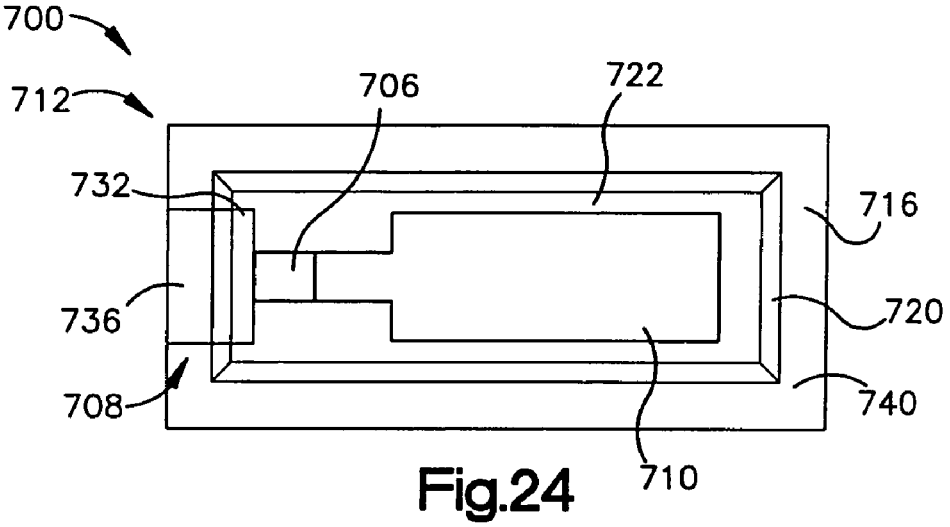
FIG. 24 is a plan view of one embodiment of the RFID device of FIG. 23.

With reference now to FIG. 24, the RFID device 700 may include a compressed border or ridge edge 740 substantially fully surrounding the device 700. Part of the compressed ridge edge 740 serves as the thinner portion 716 for capacitively coupling the second part 736 of the conductive tab 708 to the reflective structure 714. The remainder of the compressed ridge edge 740 may serve a mechanical structural function, providing a rigid edge to the RFID device 700 to prevent flexing of the RFID device 700.

Figure 25:
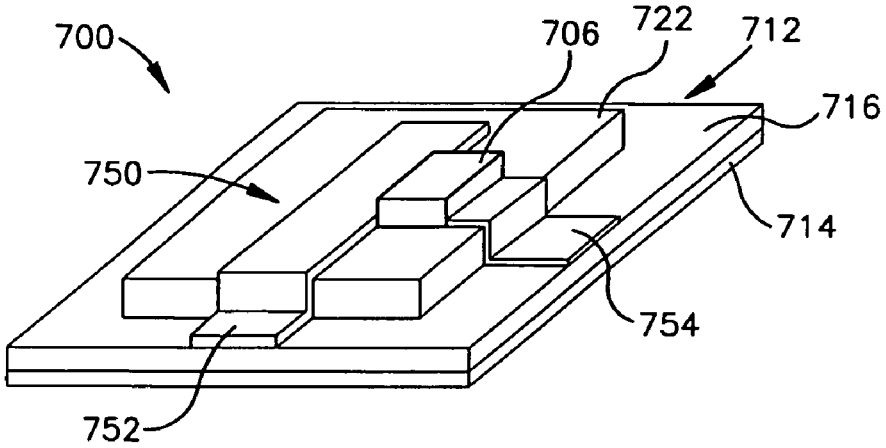
FIG. 25 is an oblique view of another embodiment of the RFID device of FIG. 23.

Another embodiment of the RFID device 700 is illustrated in FIG. 25. The RFID device in FIG. 25 includes a resonator (a conductive tab) 750 with a capacitive ground 752 at one end. The wireless communication device 706 is coupled to the resonator 750 at a suitable impedance point. The wireless communication device 706 is also coupled to a capacitive ground 754. The connection point between the wireless communication device 706 and the resonator 750 may be selected to suitably match impedances of the wireless communication device 706 and the active part of the resonator 750.

The RFID devices 700 illustrated in FIGS. 23-25 may be suitable for use as labels, such as for placement on cartons containing any of a variety of suitable materials. The RFID devices 700 may include other suitable layers, for example an adhesive layer for mounting the RFID device 700 on a carton, another type of container, or another object.

Figure 26:
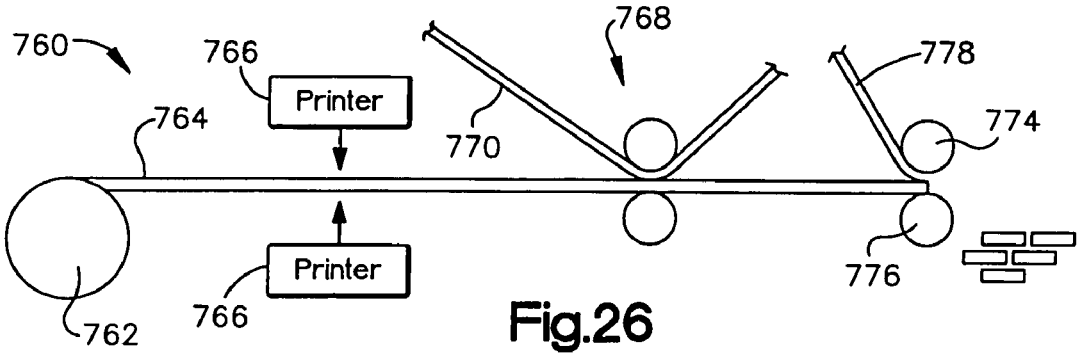
FIG. 26 is a schematic view showing a system for producing the RFID device of FIG. 23.

The RFID device 700 may be produced using suitable roll operations. FIG. 26 shows a schematic diagram of a system 760 for making RFID devices, such as the RFID device 700. Beginning with a roll 762 of a substrate material 764, a suitable printer 766 prints the conductive tabs 708 and 710 (FIG. 23) and the reflective structure 714 (FIG. 23) on opposite sides of the substrate material 764. It will be appreciated that the printer 766 may actually include multiple printers, for example to print the conductive tabs in a separate operation from the printing of the reflective structure.

A placement station 768 may be used to place the wireless communication devices 706 (FIG. 23), such as straps. The wireless communication devices 706 may be transferred to the substrate material 764 from a separate web of material 770. Alternatively, it will be appreciated that other methods may be used to couple the wireless communication devices 706 to the substrate material 764. For example, a suitable pick-and-place operation may be used to place the wireless communication devices 706.

Finally, the substrate material 764 is passed between a pair of rollers 774 and 776. The rollers 774 and 776 may be suitably heated, and have suitably-shaped surfaces, for example including suitable protrusions and/or recesses, so as to compress a portion of the substrate material 764, and to separate the RFID devices 700 one from another. In addition, a protective surface sheet 778 may be laminated onto the sheet material 764, to provide a protective top surface for the RIFD devices 700. It will be appreciated that the compressing, laminating, and cutting operations may be performed in separate steps, if desired.

It will be appreciated that other suitable processes may be used in fabricating the RFID devices 700. For example, suitable coating techniques, such as roll coating or spray coating, may be utilized for coating one side of the devices with an adhesive, to facilitate adhering the RFID devices to cartons or other containers.

The RFID device 700, with its monopole antenna structure 702, has the advantage of a smaller size, when compared with similar devices having dipole antenna structures. The length of the tag can be nearly halved with use of a monopole antenna, such as in the device 700, in comparison to a dipole antennaed device having similar size of antenna elements (conductive tabs). By having RFID devices of a smaller size, it will be appreciated that such devices may be utilized in a wider variety of applications.

Figure 27:
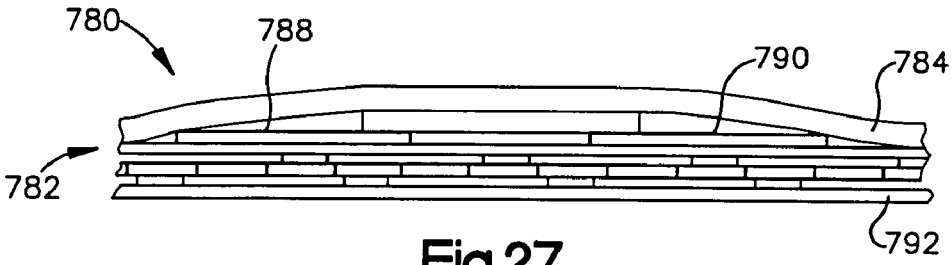
FIG. 27 is a cross sectional view of an RFID device in accordance with the present invention, having an expandable substrate.

FIG. 27 shows an RFID device 780 having an expandable substrate 782, which can be maintained during manufacturing and processing operations with a reduced thickness. The reduced thickness, which may be from about 0.05 mm to 0.5 mm, may advantageously allow the RFID device 780 to pass through standard printers, for example to print a bar code or other information on a label 784 that is part of the RFID device 780. After performing operations that take advantage of the reduced thicknesses of the substrate 782, the substrate 782 may be expanded, increasing its thickness to that shown in FIG. 27.

The RFID device 780 has many of the components of other of the RFID devices described herein, including a wireless communication device 786 and a pair of conductive tabs 788 and 790 on one side of the substrate 782, and a reflective structure (conductive ground plane) 792 on the other side of the substrate 782.

Figure 28:
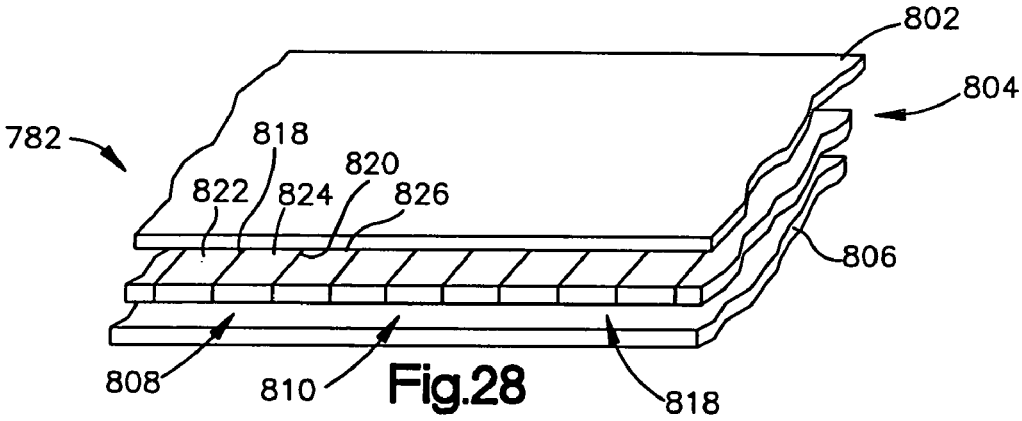
FIG. 28 is an exploded view of the expandable substrate of the device of FIG. 27.
Figure 29:
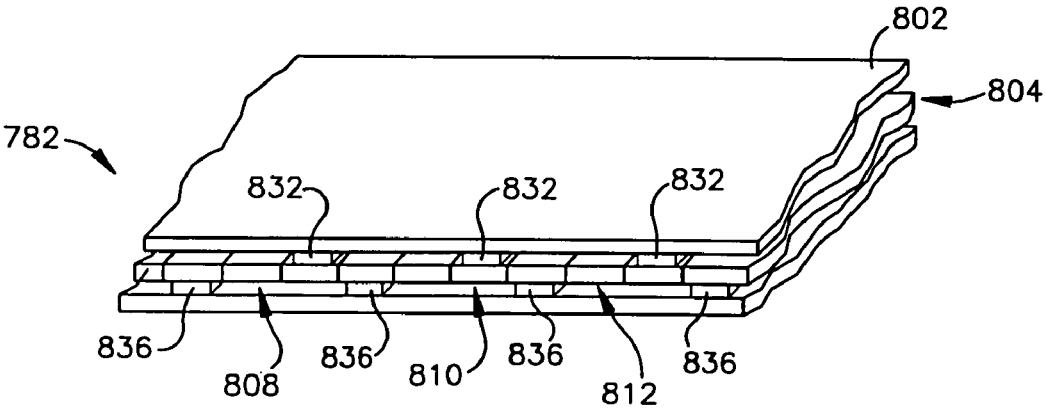
FIG. 29 is an oblique view of the expandable substrate of the device of FIG. 27, in a compressed state.
Figure 30:
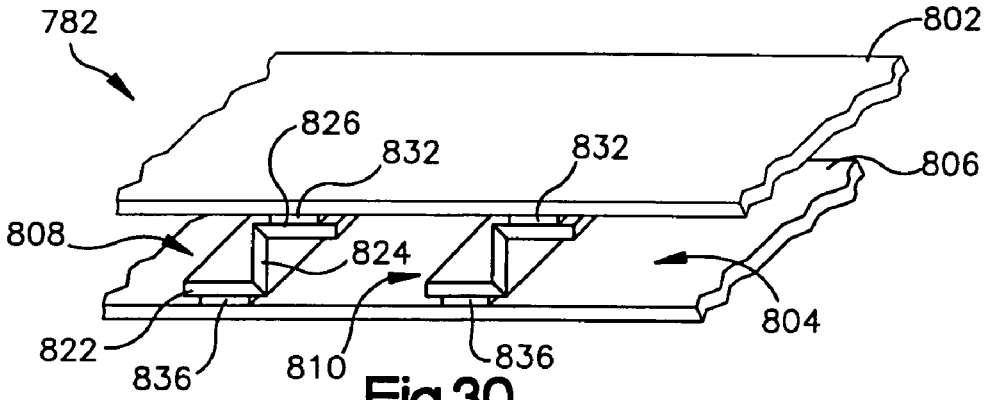
FIG. 30 is an oblique view of the expandable substrate of the device of FIG. 27, illustrating expansion of the substrate.

Referring now in addition to FIGS. 28-30, details of the structure of the expandable substrate 782 are now given. The expandable substrate 782 includes a top layer 802, a middle layer 804, and a bottom layer 806. The middle layer 804 is scored so as to be separated into segments 808, 810, and 812, as a shear force is applied to the top layer 802 relative to the bottom layer 806. The segments 808, 810, and 812 are in turn scored on fold lines, such as the fold lines 818 and 820 of the segment 808. The scoring along the fold lines 818 allows parts 822, 824, and 826 of the segment 808 to fold relative to one another as shear force is applied between the top layer 802 and the bottom layer 806.

Each of the segments 808, 810, and 812 has three parts. The top layer 802 has adhesive pads 832 selectively applied to adhere the bottom layer 802 to the parts on one side of the segments 808, 810, and 812 (the rightmost parts as shown in FIGS. 27-30). The bottom layer 806 has adhesive pads 836 selectively applied to adhere the bottom layer 806 to the parts on one side of the segments 808, 810, and 812 (the leftmost parts as shown in FIGS. 27-30). The middle parts of each of the segments 808, 810, and 812 are not adhesively attached to either the top layer 802 or the bottom layer 806, but are left free to flex relative to the segment parts on either side.

With the expandable substrate 782 put together as shown in FIG. 27, the top layer 802 and the bottom layer 806 being selectively adhered to segment parts of the middle layer 804, other operations may be performed on the substrate 782 in its compressed state. For example, the conductive tabs 788 and 790 may be formed on the top layer 802, and the reflective structure 792 may be formed or placed on the bottom layer 806. The wireless communication device 786 may be placed in contact with the conductive tabs 788 and 790. Printing operations may be performed to print on the label 784 of the RFID device 780. As noted above, the thickness of the compressed substrate 782 may allow the RFID device to pass through a standard printer for printing the label or for performing other operations. In addition, the compressed substrate 782 may be easier to use for performing other fabrication operations.

After fabrication operations that utilize the compressed substrate 782, the substrate 782 may be expanded, as illustrated in FIG. 30. When a shear force 840 is applied to the top layer 802 relative to the bottom layer 806, the top layer 802 shifts position relative to the bottom layer 806. The end parts of the segments 808, 810, and 812, some of which are adhesively adhered to the top layer 802 and others of which are adhered to the bottom layer 806, also move relative to one another. As the end parts of the segments 808, 810, and 812 shift relative to one another, the middle parts of the segments 808, 810, and 812 fold relative to the end parts along the fold lines between the segment parts. The middle parts of the segments 808, 810, and 812 thus deploy and separate the top layer 802 and the bottom layer 806, expanding the substrate 782 and increasing the thickness of the expandable substrate 782. The result is a corrugated structure. The expanded substrate 782 has low dielectric loss in comparison with solid materials. With the increased separation between the conductive tabs 788 and 790 due to expansion of the substrate 782, the expanded substrate 782 is suitable for use as a dielectric for a surface-independent RFID tag structure.

The shear force 840 between the top layer 802 and the bottom layer 806 may be applied in any of a variety of suitable ways. For example, the shear force 840 may be applied by suitably configured rollers, with the rollers having different rates of rotation or differences in gripping surfaces. Alternatively, one of the layers 802 and 806 may include a suitable heat shrink layer that causes relative shear between the layers 802 and 806 when the substrate 782 is heated.

The expandable substrate 782 may be fixed in expanded configuration by any of a variety of suitable ways, such as by pinning the ends of the layers 802 and; sticking together suitable parts of the substrate 782; filling gaps in the substrate 782 with a suitable material, such as polyurethane foam; and suitably cutting and bending inward portions of the ends of the middle parts of the segments.

The layers 802, 804, and 806 may be layers made out of any of a variety of suitable materials. The layers may be made of a suitable plastic material. Alternatively, some or all of the layers may be made of a paper-based material, such as a suitable cardboard. Some of the layers 802, 804, and 806 may be made of one material, and other of the layers 802, 804, and 806 may be made of another material.

The RFID devices 780 may be suitable for use as a label, such as for placement on cartons containing any of a variety of suitable materials. The RFID device 780 may include other suitable layers, for example an adhesive layer for mounting the RFID device 780 on a carton, another type of container, or another object.

It will be appreciated that the RFID device 780 may be used in suitable roll processes, such as the processes described above with regard to the system of FIG. 26. As stated above, the expandable substrate may be in a compressed state during some of the forming operations, for example being expanded only after printing operations have been completed.

Figure 31:
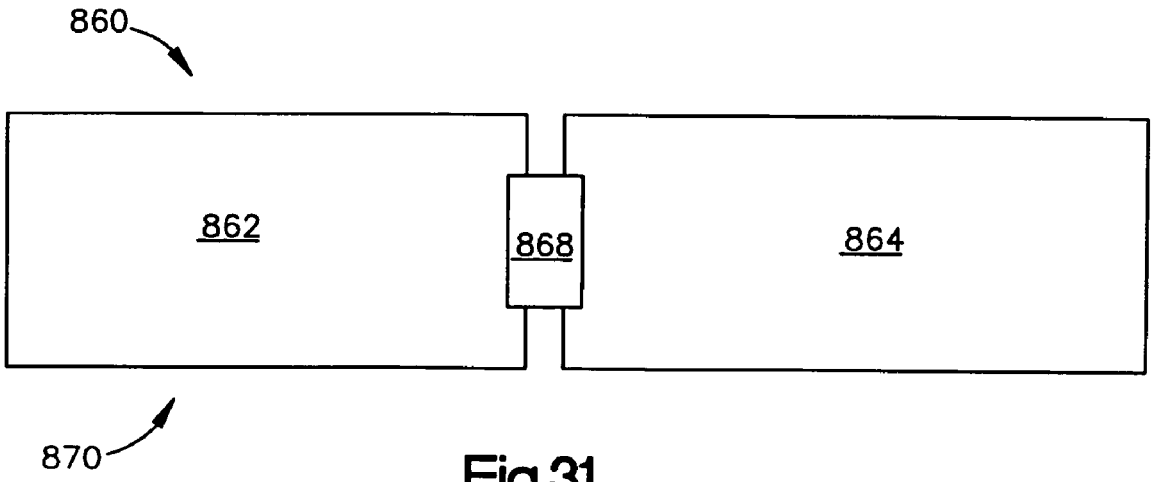
FIG. 31 is a plan view of an RFID device in accordance with the present invention, having generally rectangular conductive tabs.

FIG. 31 illustrates an RFID device 860 that has a pair of generally rectangular conductive tabs 862 and 864 that have a substantially constant width along their length. More particularly, the conductive tabs 862 and 864 each may have a substantially constant width in a direction transverse to a longitudinal centerline axis of the tab. The conductive tabs 862 and 864 form an antenna structure 870 that is coupled to a wireless communication device 868 such as an RFID chip or strap. The generally rectangular conductive tabs 862 have been found to be effective when used in conjunction with conductive structures such as the reflecting structures or ground planes described above.

It will be appreciated that the RFID device 260 is one of a wider class of devices having conductive tabs with substantially constant width, that may be effectively used with a reflective conductive structure. Such conductive tabs may have shapes other than the generally rectangular shapes illustrated in FIG. 31.

Figure 32:
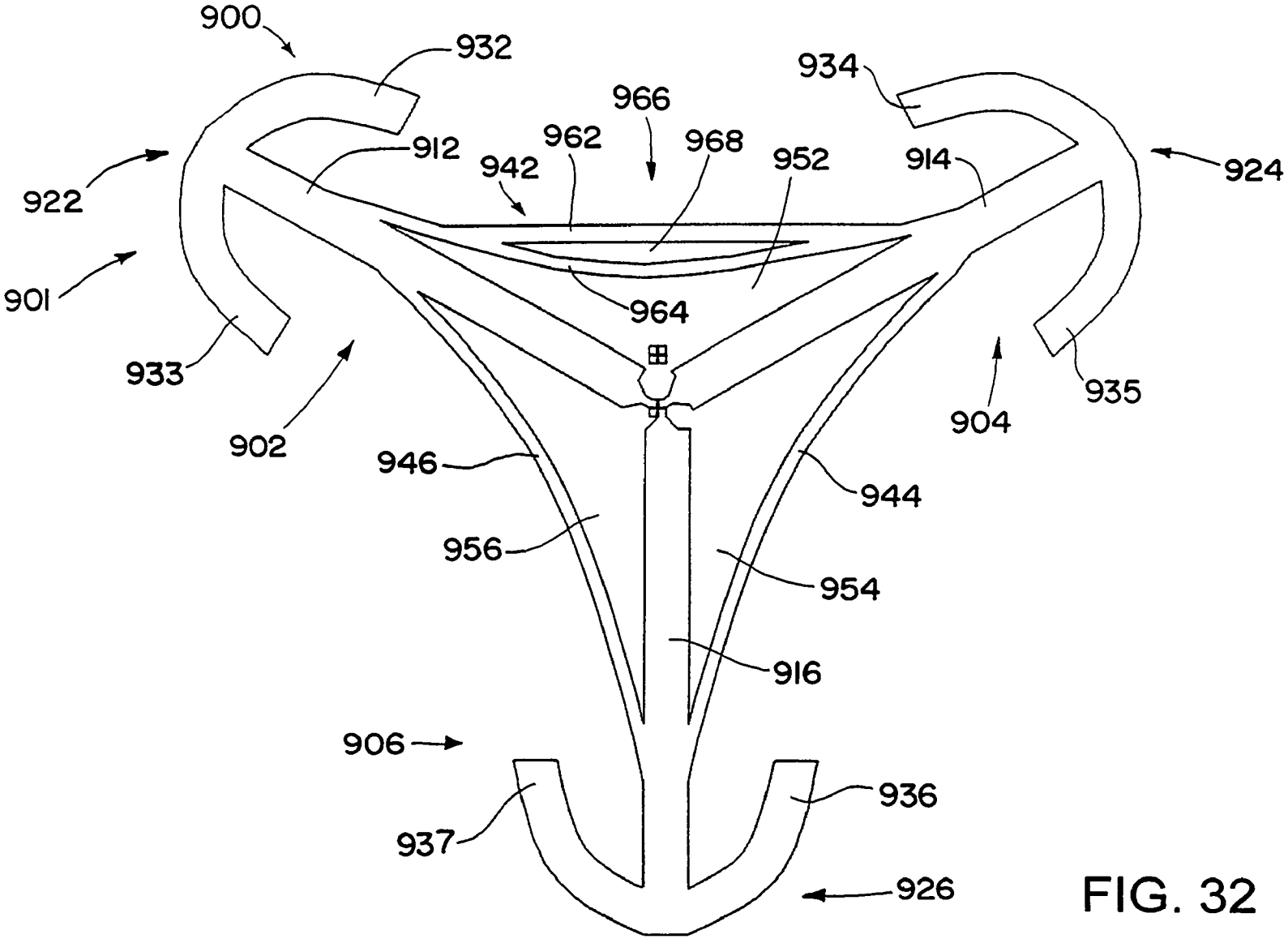
FIG. 32 is a plan view of another RFID device in accordance with the present invention.

FIG. 32 shows yet another configuration, an RFID device 900. The RFID device 900 has an antenna structure 901 with three arms or antenna elements 902, 904, and 906. The antenna elements 902, 904, and 906 have respective main antenna lines 912, 914, and 916, which have respective capacitive stubs 922, 924, and 926 at their distal ends. The capacitive stub 922 has a pair of conductive tails 932 and 933, bent back toward the main antenna line 912 on opposite sides of the main antenna line 912. The conductive tails 932 and 933 are connected to the main antenna line 912 at the distal end of the main antenna line 912, with gaps between the conductive tails 932 and 933 and the main antenna line 912 increasing along the length of the conductive tails 932 and 933. The capacitive stubs 924 and 926 have similar pairs of conductive tails 934 and 935, and 936 and 937.

The antenna structure 901 includes inductor lines 942, 944, and 946 connecting together pairs of the main antenna lines 912, 914, and 916. The inductor line 942 is coupled to the main antenna lines 912 and 914; the inductor line 944 is coupled to the main antenna lines 914 and 916; and the inductor line 946 is coupled to the main antenna lines 912 and 916. Respective gaps 952, 954, and 956 between the inductor lines 942, 944, and 946, and the main antenna lines 912, 914, and 916, are narrow close to where the inductor lines 942, 944, and 946 are joined to the main antenna lines 912, 914, and 916. The gaps 952, 954, and 956 widen out in the middle of the inductor lines 942, 944, and 946.

The inductor line 942 is split, having two elements 962 and 964 in its middle portion 966, with the elements 962 and 964 separated from one another by a gap 968. The gap 968 has variable width.

Certain modifications and improvements will occur to those skilled in the art upon a reading of the foregoing description. It should be understood that the present invention is not limited to any particular type of wireless communication device, tabs, packaging, or slot arrangement. For the purposes of this application, couple, coupled, or coupling is defined as either directly connecting or reactive coupling. Reactive coupling is defined as either capacitive or inductive coupling. One of ordinary skill in the art will recognize that there are different manners in which these elements can accomplish the present invention. The present invention is intended to cover what is claimed and any equivalents. The specific embodiments used herein are to aid in the understanding of the present invention, and should not be used to limit the scope of the invention in a manner narrower than the claims and their equivalents.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An RFID device comprising:

a dielectric layer;

an antenna structure atop a first face of the dielectric layer; and an RFID chip coupled to the antenna structure;

the antenna structure includes one or more self-compensating adaptive elements that compensate at least in part for effects of an operating environment in proximity to the antenna structure; and wherein the self-compensating elements adapts the RFID device to introduce an impedance matching network between the chip and the antenna structure to maximize power transfer between the chip and antenna structure and/or change the antenna structure to a different length.

2. The device of claim 1, wherein the compensating elements include an inter-digital capacitor.

3. The device of claim 1, wherein the compensating elements include a meander inductor;

wherein the antenna structure includes antenna elements; and wherein the meander inductor is located between the RFID chip and one of the antenna elements.

4. The device of claim 1, wherein the compensating elements include a meander inductor;

wherein the meander inductor includes multiple turns of conductive material; and wherein at least some of the multiple turns are capacitively coupled with one another.

5. The device of claim 1, wherein the compensating elements interact with dielectric material of the dielectric layer, providing different operating characteristics for the compensating elements based on characteristics of the dielectric material.

6. The device of claim 1, further comprising a conductive plane atop a second face of the dielectric layer, wherein the dielectric layer is interposed between the conductive plane and the antenna structure.

7. The device of claim 6, wherein the antenna structure and the conductive plane are formed on different parts of a single substrate, which is folded over and attached to opposite sides of the dielectric layer.

8. The device of claim 1, wherein the dielectric layer is a portion of a container.

9. The device of claim 8, further comprising a conductive plane atop a second face of the dielectric layer, wherein the dielectric layer is interposed between the conductive plane and the antenna structure.

10. The device of claim 9, wherein the conductive plane is between the antenna structure and an inner volume of the container.

11. The device of claim 9, wherein the portion is an overlapped portion of the container, with the antenna structure on one face of the portion, and the conductive plane on an opposite face of the portion.

12. The device of claim 1, wherein the antenna structure includes a pair of antenna elements coupled to the RFID chip; and wherein the dielectric layer has a non-uniform thickness, the dielectric layer having a thinner portion and a thicker portion; and wherein a portion of one of the antenna elements is on the thinner portion.

13. The device of claim 12, further comprising a conductive plane atop a second face of the dielectric layer, wherein the dielectric layer is interposed between the conductive plane and the antenna structure;

wherein the portion of the antenna element on the thinner portion of the dielectric layer is capacitively coupled to the conductive plane.

14. The device of claim 12, wherein the antenna elements are each coupled to the RFID chip at feedpoints differing in location on each of said two antenna elements.

15. The device of claim 1, further comprising a conductive plane atop a second face of the dielectric layer, wherein the dielectric layer is interposed between the conductive plane and the antenna structure;

wherein the conductive plane extends at least about 6 mm in extent beyond the antenna structure.

16. The device of claim 1, wherein the dielectric layer includes an expandable material.

17. The device of claim 1, wherein the one or more compensating elements aid in maintaining a closer impedance match between the chip and the antenna structure over a range of operating environments in proximity to the antenna structure.

18. A method of configuring an RFID device, the method comprising:

placing an antenna structure of the RFID device and a conducting plane of the RFID device opposed to one another on opposite sides of a dielectric layer; and re-tuning the antenna structure to compensate at least in part for effects of the dielectric layer on performance of the antenna structure; and wherein the re-tuning is performed by adaptive compensating elements of the antenna structure in response to being placed in proximity to the dielectric layer and the adaptive compensating elements adapts the RFID device to introduce an impedance matching network between the chip and the antenna structure to maximize power transfer between the chip and antenna structure and/or change the antenna structure to a different length.

19. The method of claim 18, wherein the compensating elements include one or more capacitive elements.

20. The method of claim 18, wherein the compensating elements include one or more inductive elements.

21. The method of claim 18, wherein the placing includes placing the antenna structure and the conducting plane on opposite sides of a container.

22. The method of claim 21, wherein the placing includes placing the conducting plane on an inside surface of the container, thereby at least partially shielding the antenna structure from effects of contents of the container.

23. The method of claim 21, wherein the placing includes placing the antenna structure and the conducting plane on opposite sides of an overlapping portion of the container.

24. A method of employing an RFID device, the method comprising:

providing the RFID device, wherein the RFID device includes:

an RFID chip; and an antenna structure coupled to the RFID chip, wherein the antenna structure includes one or more compensating elements;

placing the RFID device in proximity to one or more dielectric materials and/or conductive materials, wherein the placing causes alteration of operating characteristics of the antenna structure, away from impedance matching between the antenna structure and the RFID chip;

compensating for the alteration of the operating characteristics of the antenna structure with adaptive compensating elements in response to the proximity to the one or more dielectric materials and/or conductive materials, to bring the antenna structure and the RFID chip toward impedance matching; and wherein the compensating elements adapts the RFID device to introduce an impedance matching network between the chip and the antenna structure to maximize power transfer between the chip and antenna structure and/or change the antenna structure to a different length.

25. The method of claim 24, wherein the one or more compensating elements an impendence matching network between the RFID chip and antenna elements of the antenna structure; and wherein the compensating includes compensating includes using the impedance matching network to bring the antenna structure and the RFID chip toward impedance matching.

26. The method of claim 24, wherein the compensating includes changing effective length of antenna elements of the antenna structure.

27. The method of claim 24, wherein the placing includes placing the RFID device on a container.

28. The method of claim 27, wherein the one or more dielectric materials and/or conductive materials includes a wall of the container.

29. The method of claim 28, further comprising placing a conductive structure on the wall on an opposite side of the wall from the antenna structure and the chip.

30. The method of claim 29, wherein the placing of the conductive structure includes placing the conductive structure is on an interior side of the container, closer to contents of the container than the antenna structure and the chip.

31. The method of claim 29, wherein the placing of the conductive structure and the placing of the RFID device results in the conductive structure substantially overlapping the antenna structure and the chip.

32. The method of claim 27, wherein the placing the RFID device on the container includes placing the RFID device on an overlapping portion of a carton.

33. The method of claim 27, wherein the one or more dielectric materials and/or conductive materials include contents of the container.

34. An RFID device comprising:

a dielectric layer;

an antenna structure atop a first face of the dielectric layer; and an RFID chip coupled to the antenna structure;

the antenna structure includes a self-compensating adaptive electrical conductor that forms a capacitance element that interacts with contents of a container in proximity to the antenna structure to compensate at least in part for the effects such contents have on the antenna structure; and wherein the self-compensating adaptive electrical conductor adapts the RFID device to introduce an impedance matching network between the chip and the antenna structure to maximize power transfer between the chip and antenna structure and/or change the antenna structure to a different length.

35. An RFID device comprising:

a dielectric layer;

an antenna structure atop a first face of the dielectric layer; and an RFID chip coupled to the antenna structure;

the antenna structure includes a self-compensating adaptive electrical conductor having a gap that interacts with contents of a container in proximity to the antenna structure to render the antenna structure less sensitive to the effects such contents have on the antenna structure; and wherein the self-compensating adaptive electrical conductor adapts the RFID device to introduce an impedance matching network between the chip and the antenna structure to maximize power transfer between the chip and antenna structure and/or change the antenna structure to a different length.

* * * * *